US011859321B2

(12) United States Patent
Dion et al.

(10) Patent No.: US 11,859,321 B2
(45) Date of Patent: Jan. 2, 2024

(54) MODULAR TOOL FOR DESIGN OF SELF-FOLDING KNIT FABRICS

(71) Applicants: Drexel University, Philadelphia, PA (US); The Trustees of the University of Pennsylvania, Philadelphia, PA (US)

(72) Inventors: Genevieve Eugenie Dion, Philadelphia, PA (US); Chelsea Elizabeth Amanatides, Philadelphia, PA (US); Randall Kamien, Philadelphia, PA (US)

(73) Assignees: Drexel University, Philadephia, PA (US); The Trustees of the University of Pennsylvania, Philadelphia, PA (US)

( * ) Notice: Subject to any disclaimer, the term of this patent is extended or adjusted under 35 U.S.C. 154(b) by 0 days.

(21) Appl. No.: 17/710,915

(22) Filed: Mar. 31, 2022

(65) Prior Publication Data

US 2022/0316108 A1 Oct. 6, 2022

Related U.S. Application Data

(60) Provisional application No. 63/168,830, filed on Mar. 31, 2021.

(51) Int. Cl.
*D04B 37/00* (2006.01)
*D04B 15/80* (2006.01)
(Continued)

(52) U.S. Cl.
CPC ..... *D04B 37/00* (2013.01); *D04B 1/102* (2013.01); *D04B 15/80* (2013.01); *D04B 21/06* (2013.01)

(58) Field of Classification Search
CPC ..... D04B 37/02; D04B 15/80; D04B 1/102; D04B 21/06; D04B 37/00; G05B 19/40932; G05B 19/40931; G05B 2219/45194
See application file for complete search history.

(56) References Cited

U.S. PATENT DOCUMENTS 5,016,183 A 5/1991 Shyong
5,255,352 A 10/1993 Falk
(Continued)

FOREIGN PATENT DOCUMENTS

WO WO 2008/122751 A2 10/2008
WO WO 2019/182964 A1 9/2019

OTHER PUBLICATIONS

Liu et al. "On the role of material architecture in the mechanical behavior of knitted textiles," International Journal of Solids and Structures, vol. 109, pp. 101-111 (2017).
(Continued)

*Primary Examiner* — Danny Worrell
(74) *Attorney, Agent, or Firm* — Jenkins, Taylor & Hunt, P.A.

(57) ABSTRACT

A method for designing a knitted textile or fabric, the method includes receiving graphical input from a user regarding a knit pattern comprised of different types of individual stitches to be included in a textile or fabric design. The method further includes graphically displaying a representation of the textile or fabric design. The method further includes merging sections of continuous stitches of the same type into at least one block. The method further includes graphically displaying the textile or fabric design as a pattern of the at least one block. The method further includes applying edge rolling indicators and/or folding indicators to the displayed pattern of the at least one block, where the edge rolling and/or folding indicators respectively and graphically illustrate predicted edge rolling and folding behaviors of a physical textile or fabric.

20 Claims, 27 Drawing Sheets
(25 of 27 Drawing Sheet(s) Filed in Color)

(51) Int. Cl.
*D04B 1/10* (2006.01)
*D04B 21/06* (2006.01)

(56) References Cited

U.S. PATENT DOCUMENTS

| | | | | |
|---|---|---|---|---|
| 6,880,367 | B2 * | 4/2005 | Suzuki | G06T 11/001 66/232 |
| 7,058,471 | B2 * | 6/2006 | Watanabe | A41H 1/10 112/475.09 |
| 7,092,782 | B2 * | 8/2006 | Lee | G06Q 30/02 700/132 |
| 7,127,321 | B2 * | 10/2006 | Kenji | D04B 1/24 66/232 |
| 7,385,601 | B2 | 6/2008 | Bingham et al. | |
| 7,386,360 | B2 * | 6/2008 | Noriyuki | G06T 11/001 700/131 |
| 7,650,018 | B2 * | 1/2010 | Tetsuji | G06T 11/001 345/589 |
| 7,738,990 | B2 * | 6/2010 | Furukawa | G06F 30/20 66/238 |
| 8,000,829 | B2 * | 8/2011 | Terai | D04B 37/02 700/141 |
| 8,135,489 | B2 * | 3/2012 | Terai | D04B 1/126 66/232 |
| 8,300,044 | B2 * | 10/2012 | Furukawa | G06T 17/00 66/193 |
| 9,107,462 | B1 | 8/2015 | Heinrich et al. | |
| 11,293,124 | B2 * | 4/2022 | Morgan | G05B 19/4097 |
| 11,761,128 | B2 | 9/2023 | Dion et al. | |
| 2007/0088453 | A1 * | 4/2007 | Noriyuki | G06T 11/001 700/141 |
| 2007/0203608 | A1 | 8/2007 | Kang | |
| 2009/0091065 | A1 | 4/2009 | Katti et al. | |
| 2010/0023305 | A1 | 1/2010 | Furukawa et al. | |
| 2011/0046715 | A1 | 2/2011 | Ugbolue et al. | |
| 2018/0305847 | A1 | 10/2018 | Wen et al. | |
| 2019/0153640 | A1 | 5/2019 | Levinson et al. | |

OTHER PUBLICATIONS

Vittal et al., "Digital fabrication of textiles: an analysis of electrical networks in 3D knitted functional fabrics," Proc. SPIE, Micro- and Nanotechnology Sensors, Systems, and Applications IX, pp. 1-18 (May 18, 2017).
Levitt et al., "Investigation of nanoyarn preparation by modified electrospinning setup," Journal of Applied Polymer Science, pp. 1-8 (2017).
Vallett et al., "Development of a Carbon Fiber Knitted Capacitive Touch Sensor," MRS Advances, pp. 1-11 (2016).
Knittel et al., "Self-Folding Textiles through Manipulation of Knit Stitch Architecture," Fibers, vol. 3, pp. 1-13 (2015).
Witkin et al., "Energy Constraints on Parameterized Models," SIGGRAPH '87: Proceedings of the 14th annual conference on Computer graphics and interactive techniques, pp. 1-7 (1987).
Kaldor et al., "Efficient Yarn-based Cloth with Adaptive Contact Linearization," ACM Transactions on Graphics, vol. 29, Issue 4, pp. 1-10 (Jul. 2010).
Kaldor et al., "Simulating Knitted Cloth at the Yarn Level," In Proceedings of SIGGRAPH 2008, pp. 1-9 (2008).
Kuiwu et al., "Knittable Stitch Meshes," ACM Trans. Graph, vol. 38, No. 1, pp. 1-9 (Jan. 2019).
Notification of Transmittal of the International Search Report and the Written Opinion of the International Searching Authority, or the Declaration for International Application Serial No. PCT/US2019/022733 (May 29, 2019).
Leaf et al., "Interactive Design of Periodic Yarn-Level Cloth Patterns," ACM Trans. Graph., vol. 37, No. 6, pp. 1-15 (Nov. 2018).
Liu et al., "A Computational Approach to Model Interfacial Effects on the Mechanical Behavior of Knitted Textiles," Journal of Applied Mechanics, vol. 85, pp. 1-12 (Apr. 2018).
Poincloux et al., "Geometry and Elasticity of a Knitted Fabric," Physical Review X, vol. 8, pp. 1-14 (2018).
Cirio et al., "Yarn-Level Cloth Simulation with Sliding Persistent Contacts," In IEEE Transactions on Visualization and Computer Graphics, vol. 23, No. 2, pp. 1152-1162 (Feb. 2017).
Guo et al., "Modelling and Simulation of Weft Knitted Fabric Based on Ball B-Spline Curves and Hooke's Law," 2015 International Conference on Cyberworlds, IEEE, pp. 1-4 (2015).
Jevsnik et al., "Review of Computer Models for Fabric Simulation," Tekstilec, pp. 1-16 (2014).
Lin et al., "Automated geometric modelling of textile structures," https://doi.org/10.1177/0040517511418562, vol. 82, Issue 16, pp. 1-25 (2012).
Yuksel et al., "Stitch Meshes for Modeling Knitted Clothing with Yarn-level Detail," ACM TOG, vol. 31, No. 3, SIGGRAPH 2012, pp. 1-12 (2012).
Grishanov et al., "Advances in the CAD Simulation of Textile Yarns," RJTA, vol. 15, No. 1, pp. 1-10 (2011).
Long et al., "Cloth Modeling and Simulation: A Literature Survey," Digital Human Modeling, HCII 2011, LNCS 6777, pp. 1-9 (2011).
Grishanov et al., "A Topological Study of Textile Structures. Part I: An Introduction to Topological Methods," Textile Research Journal, vol. 79, No. 702, pp. 1-14 (2009).
Grishanov et al., "A Topographical Study of Textile Structures. Part II: Topological Invariants in Application to Textile Structures," Textile Research Journal, vol. 79, No. 822, pp. 1-17 (2009).
Igarashi et al., "Knitty: 3D Modeling of Knitted Animals with a Production Assistant Interface," Eurographics 2008, pp. 1-4 (2008).
Igarashi et al., "Knitting a 3D Model," Pacific Graphics 2008, vol. 27, No. 7, pp. 1-7 (2008).
Roach et al., "Progress in superhydrophobic surface development," Soft Matter, pp. 224-240 (Jan. 2008).
Kyosev et al., "3D Modelling of Plain Weft Knitted Structures of Compressible Yarn," RJTA, vol. 9, No. 1, pp. 1-11 (2005).
Lomov et al., "Hierarchy of Textile Structures and Architecture of Fabric Geometric Models," Textile Research Journal, vol. 71, No. 6, pp. 534-543 (2001).
Matsumoto et al., "Smectic pores and defect cores," Interface Focus, vol. 2, pp. 1-6 (2012).
Sherburn, "Geometric and Mechanical Modelling of Textiles," University of Nottingham, pp. 1-272 (2007).
Kamien, "Decomposition of the Height Function of Scherk's First Surface," arXiv:math-ph/0008039v3, pp. 1-5 (Dec. 22, 2000).
Meibner et al., "The Art of Knitted Fabrics, Realistic & Physically Based Modelling of Knitted Patterns," Eurographics, vol. 17, No. 3, pp. 1-8 (1998).
Kurbak et al., "Basic Studies for Modeling Complex Weft Knitted Fabric Structures Part I: A Geometrical Model for Widthwise Curlings of Plain Knitted Fabrics," Textile Research Journal, vol. 78, No. 3, pp. 1-11 (2008).
Arnlind et al., "The World as Quantized Minimal Surfaces," arXiv:1211.1202v1, pp. 1-7 (Nov. 6, 2012).
Peirce et al., "5—the Geometry of Cloth Structure," Journal of the Textile Institute Transactions, vol. 28, No. 3, pp. 1-56 (1937).
Hotte, "An Investigation of Fabric Structure and It's Relation to Certain Physical Properties," Textile Research Journal, vol. 20, No. 12, pp. 811-828 (1950).
Leaf et al., "A Generalized Model of Plain Woven Fabric," Textile Research Journal, vol. 55, No. 2, pp. 1-8 (Feb. 1985).
Hu et al., "Review of cloth modeling," in 2009 ISECS International Colloquium on Computing, Communication, Control, and Management, vol. 4, pp. 338-341 (2009).
Zhao et al., "Permeability measurements and modeling of topology-optimized metallic 3-D woven lattices," Acta Materialia, vol. 81, pp. 326-336 (Dec. 2014).
Zhao et al., "Experimental investigation of 3D woven Cu lattices for heat exchanger applications," International Journal of Heat and Mass Transfer, vol. 96, pp. 296-311 (May 2016).
Zhang et al. "Fabrication and mechanical characterization of 3D woven Cu lattice materials," Materials & Design, vol. 85, pp. 743-751 (Nov. 2015).

(56) References Cited

OTHER PUBLICATIONS

Guest et al., "Achieving minimum length scale in topology optimization using nodal design variables and projection functions," Int. J. Numer. Meth. Engng., vol. 61, No. 2, pp. 238-254 (Sep. 2004).
Osanov et al., "Topology Optimization for Architected Materials Design," Annual Review of Materials Research, vol. 46, No. 1, pp. 211-233 (2016).
Santangelo et al., "Triply periodic smectic liquid crystals," Phys. Rev. E, vol. 75, No. 1, pp. 1-12 (Jan. 2007).
Santangelo et al., "Elliptic Phases: A Study of the Nonlinear Elasticity of Twist-Grain Boundaries," Phys. Rev. Lett., vol. 96, No. 13, p. 1-4 (Apr. 2006).
Plateau et al., "Statique Expe'rimentale et The'orique des Liquides Soumis aux Seules Forces Mole'culaires," Nature, vol. X, No. 242, pp. 119-121 (Jun. 18, 1874).
Taylor, "The structure of singularities in soap-bubble-like and soap-film like minimal surfaces," Annals of Mathematics, 2nd Series, vol. 103, No. 3, pp. 1-52 (1976).
Hajduk et al., "The gyroid: A new equilibrium morphology in weakly segregated diblock copolymers", Macromolecules, vol. 27, No. 15, pp. 4063-4075 (1994).
Torquato et al., "Minimal surfaces and multifunctionality, Proceedings of the Royal Society of London," Series A: Mathematical, Physical and Engineering Sciences, vol. 460, No. 2047, pp. 1-9 (2004).
Knittel, et al., "Modelling textile structures using bicontinuous surfaces, under review," Journal of Mathematics and the Arts, arXiv:1807.03627, pp. 1-17 (2018).
Leaf et al., "The geometry of a plain knitted loop," Journal of the Textile Institute Transactions, vol. 46, No. 9, pp. 1-22 (1955).
Munden, "The geometry and dimensional properties of plain-knit fabrics," Journal of the Textile Institute Transactions, vol. 50, No. 7, pp. 1-27 (1959).
Demiroz et al., "A study of the graphical representation of plain knitted structures part I: Stitch model for the graphical representation of plain-knitted structures," Journal of the Textile Institute, vol. 91, No. 4, pp. 1-20 (2000).
Kurbak "Geometrical models for balanced rib knitted fabrics part I: Conventionally knitted rib fabrics," Textile Research Journal, vol. 79, No. 5, pp. 1-18 (2009).
Shanahan et al., "A theoretical analysis of the plain-knitted structure," Textile Research Journal, vol. 40, No. 7, pp. 656-665 (1970).
Hepworth et al., "The mechanics of an idealized weft-knitted structure," Journal of the Textile Institute, vol. 67, No. 7-8, pp. 1-10 (1976).
De Jong et al., "Energy analysis of mechanics of weft-knitted fabrics by means of optimal-control theory. part I: Nature of loop-interlocking in plain-knitted structure," Journal of The Textile Institute, vol. 68, No. 10, pp. 1-11 (1977).
Semnani et al., "A new aspect of geometrical and physical principles applicable to the estimation of textile structures: An ideal model for the plain-knitted loop," Journal of the Textile Institute, vol. 94, No. 3-4, pp. 1-12 (2003).
Choi et al., "An energy model of plain knitted fabric," Textile Research Journal, vol. 73, No. 8, pp. 739-748 (2003).
Choi et al., "The shape and dimensions of plain knitted fabric: A fabric mechanical model," Textile Research Journal, No. 76, No. 10, pp. 777-786 (2006).
Duhovic et al., "Simulating the deformation mechanisms of knitted fabric composites," Composites Part A: Applied Science and Manufacturing, vol. 37, pp. 1897-1915 (2006).
Eberhardt et al., "Knit fabrics, in: D. House," D. Breen (Eds.), Cloth Modeling and Animation, AK Peters, pp. 1-26 (2000).
Wu et al., "Stitch meshing," ACM Transactions on Graphics, vol. 37, No. 4, pp. 130:1-130:14 (2018).
Mccann et al., "A Compiler for 3D Machine Knitting," ACM Transactions on Graphics, vol. 35, No. 4, pp. 1-11 (2016).
Narayanan et al., "Automatic machine knitting of 3D meshes," ACM Transactions on Graphics, vol. 37, No. 3, pp. 1-15 (2018).
Lin et al., "Efficient transfer planning for flat knitting," in: Proc. 2nd ACM Symposium on Computational Fabrication, vol. 5, pp. 1-7 (2018).
Conty, "Flexible Fabrication: Knitting Yarns in Architecture", pp. 1-141 (2009).
Notice of Allowance and Examiner-Initiated Interview Summary for U.S. Appl. No. 16/981,681 (dated May 15, 2023).

* cited by examiner

Basic Knit and Purl Stitch Patterns with 0 and 90 degree angles

| | Description of Pattern Condition | Example of Pattern Condition | Edge Rolling and/or Folding Indicator for Pattern Condition | Example of Pattern Condition with Specific Indicators Applied. | Example of Pattern Condition with ALL Indicators Applied. | Examples of Pattern Condition with ALL Indicators Applied, with Adjacent Stitch Segment. |
|---|---|---|---|---|---|---|
| Basic Knit Segments | A vertically oriented edge of a knit segment located on the right side edge. | ← | No Indicator | | | |
| | A vertically oriented edge of a knit segment located on the left side edge. | → | No Indicator | | | |
| | A horizontally oriented edge of a knit segment located at its top side edge. | ↓ | ..... | | | |
| | A horizontally oriented edge of a knit segment located at its bottom side edge. | ↑ | ..... | | | |
| Basic Purl Segments | A vertically oriented edge of a purl segment located at its right side edge. | ← | ¦ | | | |
| | A vertically oriented edge of a purl segment located at its left side edge. | → | ¦ | | | |
| | A horizontally oriented edge of a purl segment located at its top side edge. | ↓ | No Indicator | | | |
| | A horizontally oriented edge of a purl segmented located at its bottom side edge. | ↑ | No Indicator | | | |

FIG. 5

Knit and Purl Stitch Patterns with Angles Other Than 0 and 90

| Description of Pattern Condition | Example of Pattern Condition | Edge Rolling and/or Folding indicator for Pattern Condition | Example of Pattern Condition with Specific Indicators Applied. | Example of Pattern Condition with ALL Indicators Applied | Examples of Pattern Condition with ALL Indicators Applied with Adjacent Stitch Segments. |
|---|---|---|---|---|---|
| A top/left or top/right edge of a knit segment at an angle greater than 45 degrees. | | No Indicator | | | |
| A top/left or top/right edge of a knit segment at an angle of less than 45. | | | | | |
| A bottom/left or bottom/right edge of a knit segment at an angle greater than 45 degrees. | | No Indicator | | | |
| A bottom/left or bottom/right edge of a knit segment at an angle less than 45 degrees | | | | | |
| A top/left or top/right edge of a purl segment at an angle of greater than 45 degrees. | | | | | |
| A top/left or top/right edge of a purl segment at an angle less than 45 degrees. | | No Indicator | | | |
| A bottom/ left or bottom/right edge of a purl segment at an angle greater than 45 degrees. | | | | | |
| A bottom/left or bottom/right edge of a purl segment at an angle less than 45 degrees. | | No Indicator | | | |
| A bottom/left or bottom /right edge of a purl segment at an angle of 45 degrees | | No Indicator | | | |
| A top/left or top/right edge of a knit segment at an angle of 45 degrees. | | No Indicator | | | |
| A top/left or top/right edge of a purl segment at an angle of 45 degrees | | No Indicator | | | |
| A bottom/left or bottom/right edge of a knit segment at an angle of 45 degrees | | No Indicator | | | |

FIG. 6

Mountain and Valley Folds in Knit and Purl Stitch Patterns with Angles Other Than 0 and 90

| Description of Pattern Condition | Example of Pattern Condition | Edge Rolling and/or Folding Indicator for Pattern Condition | Example of Pattern Condition with Specific Indicators Applied. | Example of Pattern Condition with ALL Indicators Applied. | Example of Pattern Condition with ALL Indicators Applied with Adjacent Stitch Segment. |
|---|---|---|---|---|---|
| If two corners (≠90 degrees) of knit segments can be connected by a vertical line, a mountain fold indicator will be placed along the longest continuous segment, such that it never overlaps any purl stitches. | | | | | |
| If two corners (≠90 degrees) of purl segments can be connected horizontally, a mountain fold indicator will be placed along the longest continuous segment, such that it never overlaps any knit stitches. | | | | | |
| If two corners (≠90 degrees) of purl segments can be connected by a vertical line, a valley fold indicator will be placed along the longest continuous segment, such that it never overlaps any knitstitches. | | | | | |
| If two corners (≠90 degrees) of knit segments can be connected horizontally, a valley fold indicator will be placed along the longest continuous segment, such that it never overlaps any purl stitches. | | | | | |

FIG. 7

Step 1)
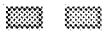
Step 2)
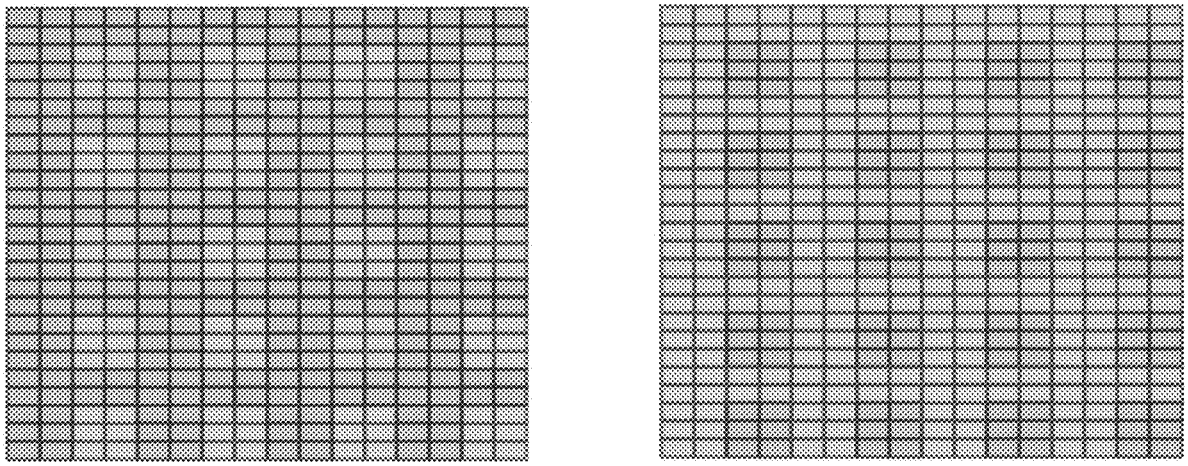
(Left: Fabric front, Right: Fabric back)
Step 3)
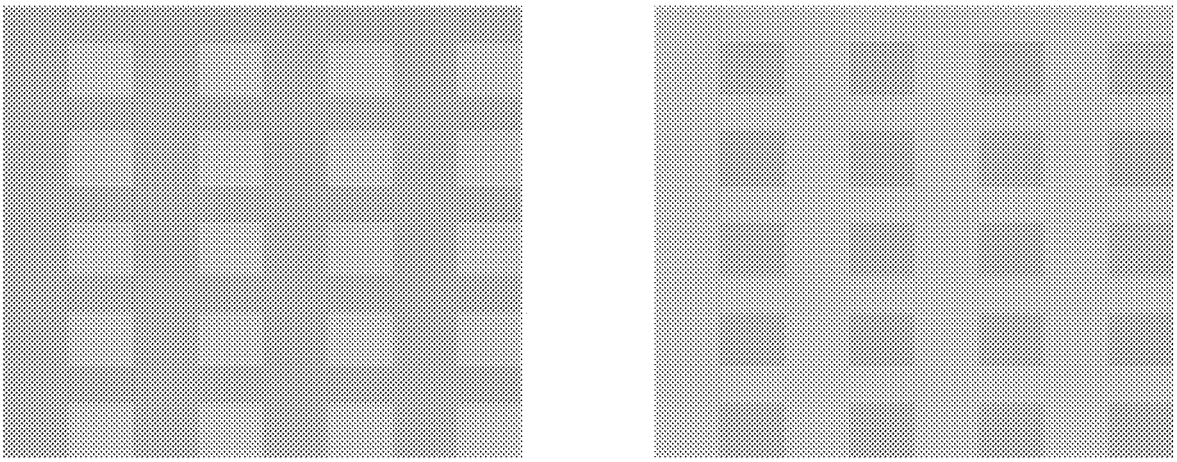
(Left: Fabric front, Right: Fabric back)
*FIG. 12A*

Step 4)
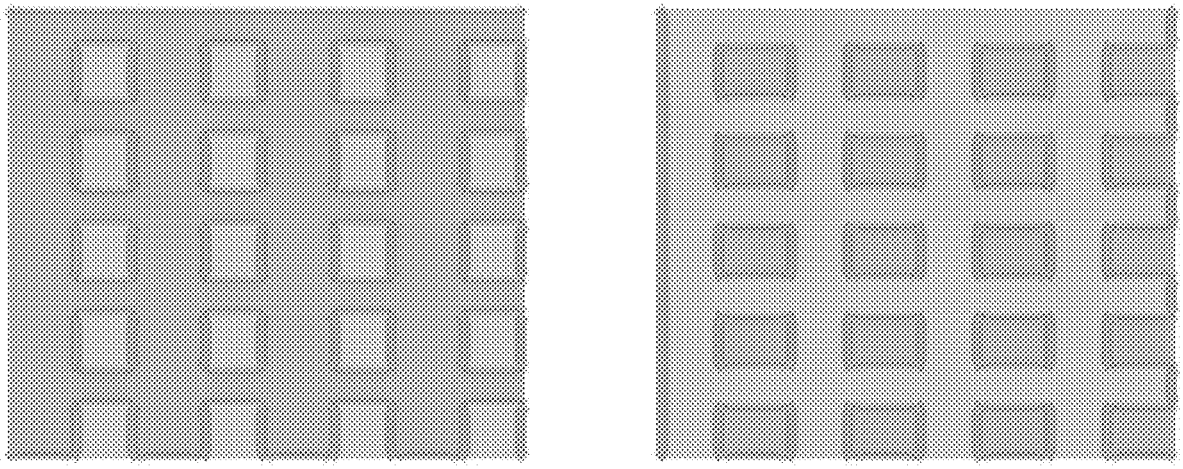
(Left: Fabric front, Right: Fabric back)
Step 4)
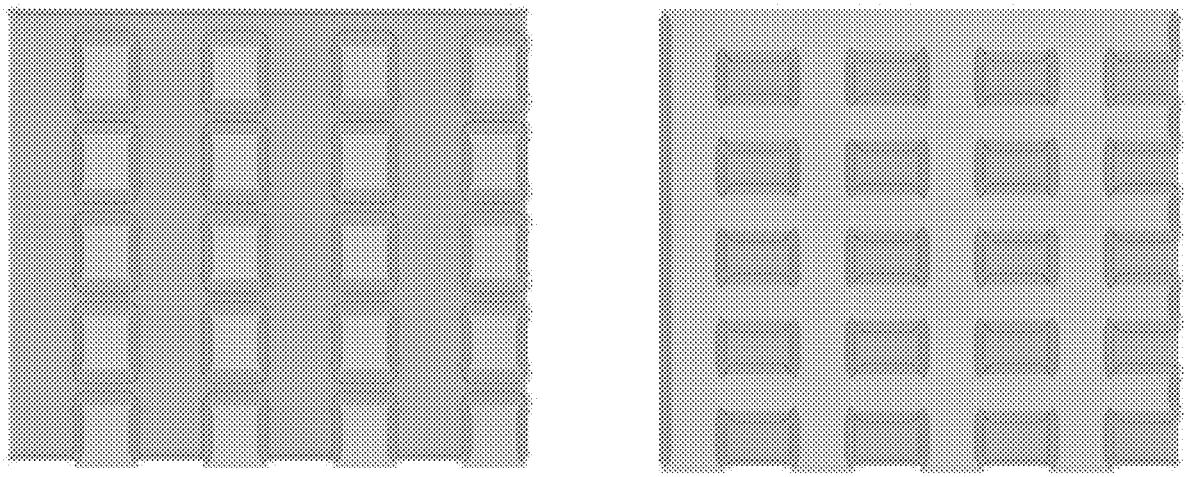
(Left: Fabric front, Right: Fabric back)
*FIG. 12B*

Step 1)
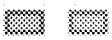
Step 2)
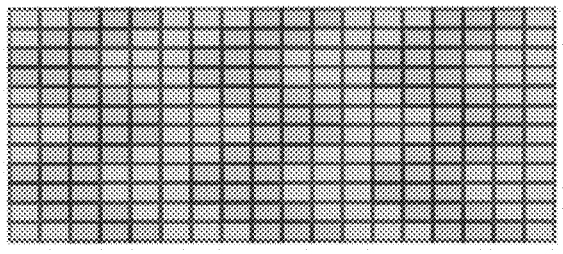
Step 1)
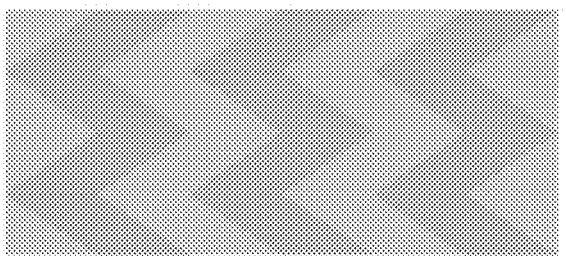
Step 4)
With edge rolling indicators
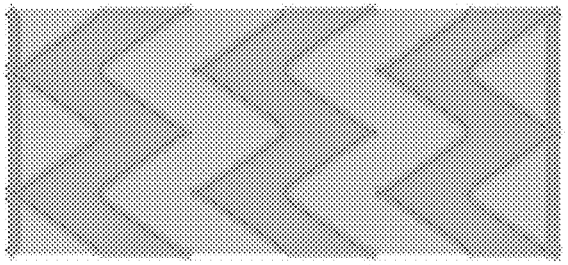
With edge rolling indicators AND
folding indicators
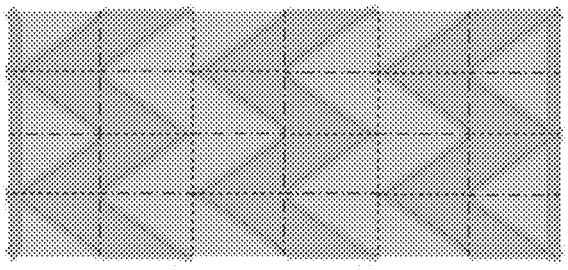
FIG. 13

MODULAR TOOL FOR DESIGN OF SELF-FOLDING KNIT FABRICS

PRIORITY CLAIM

This application claims the priority benefit of U.S. Provisional Patent Application Ser. No. 63/168,830, filed Mar. 31, 2021, the disclosure of which is incorporated herein by reference in its entirety.

GOVERNMENT INTEREST

This invention was made with government support under grant number 1537720 awarded by the National Science Foundation and grant number w15QKN-16-3-001 awarded by the United States Army. The government has certain rights in the invention.

TECHNICAL FIELD

The subject matter described herein relates to predicting fabric edge rolling and folding behaviors of a textile or fabric design. More particularly, the subject matter described herein relates to a modular tool for design of self-folding knit fabrics.

BACKGROUND

In the areas of textile and fabric design, it is desirable to predict the mechanical deformation behaviors, such as folding or edge rolling behaviors of a physical design before putting the design into production. One method for determining the mechanical deformation behaviors of a textile or fabric design is to produce a limited quantity of articles with the design, observe the resulting fabric, measure the mechanical deformation behaviors, make changes, and repeat the process until desired mechanical deformation behaviors are achieved. Such a trial and error process is inefficient and increases cost and time for textile or fabric production.

Accordingly, in light of these and other difficulties, there exists a need for improved methods, systems, and computer readable media for predicting mechanical deformation behaviors of a textile or fabric design.

SUMMARY

Using basic knit stitches, knit and purl (which may also be referred to as face and reverse stitches or front and back stitches), complex self-folding and buckling behaviors can be produced as a result of fabric relaxation and of the knit and purl stitch transition forces. To date, commercially available modeling software is unable to accurately model and predict this behavior based on a given pattern of knit and purl stitches.

The tool described here was developed to overcome this challenge and allow for prediction of self-folding behaviors in weft knits.

The subject matter described herein consists of a visual design tool that can be used to predict the outcome of self-folding fabrics made using knit and purl stitches. Specifically, it is a tool that can be used to predict or reverse engineer three dimensional knit structures that are origami-like.

This tool is used to create a visual representation of self-folding in knit and purl stitch patterns that will help the user understand and predict the edge rolling deformation, torque and folding behaviors that will occur in the physical fabric.

The user can input measured fabric properties, such as the stitch aspect ratio, to determine the initial geometry of a desired stitch pattern. The user can lay out the knit and purl pattern, stitch by stitch.

The tool then applies indicators to the stitch pattern, to demonstrate the self-folding behavior that will occur. Multiple types of indicators can be applied, as needed to indicate different deformation behaviors. For example, two types can be used to indicate a) edge rolling deformation behaviors that occur at the transitions from knit to purl stitches, b) folding deformations that traverse through segments of knit and purl stitches, producing folding similar to the "mountain and valley" folds of origami.

The tool can further input the measured ratio of horizontal vs vertical knit to purl transition folding forces, if known, to scale the impacts of the knit and purl segments and further approximate the final outcome of the fabric.

Both with and without the folding forces scaling factor, this tool provides a visual representation of the direction of deformation at each zone of transition between stitch types and the folding that occurs as a result of fabric buckling and deformation, indicating whether it is into or out of the plane.

Our approach provides a method of predicting fabric folding and deformation behaviors that is less computationally complex than typical methods pursued. This system does not depend on modeling of individual loops, instead it models the boundary condition behaviors and internal deformation behaviors of macroscale components of stitches, allowing for homogenization of the internal fabric plane. Furthermore, this system was developed on fundamental understanding of boundary condition behaviors (when a stitch transitions form knit to purl and vice versa) that will always occur, regardless of material or method used to fabricate the weft knit structure. Therefore, the folding and other deformation behavior of knit and purl stitch patterns can be predicted accurately without the need to measure or understand the yarn properties or other fabrication variables.

Additionally, this is to our knowledge the only tool being developed to predict the outcome of self-folding knit and purl stitch patterns. Therefore, this provides an advantage over the current method of trial and error.

A method for designing a knitted textile or fabric, the method includes receiving graphical input from a user regarding a knit pattern comprised of different types of individual stitches to be included in a textile or fabric design. The method further includes graphically displaying a representation of the textile or fabric design. The method further includes merging sections of continuous stitches of the same type into at least one block. The method further includes graphically displaying the textile or fabric design as a pattern of the at least one block. The method further includes applying edge rolling and/or folding indicators to the displayed pattern of the at least one block, where the edge rolling and/or folding indicators respectively and graphically illustrate predicted edge rolling and folding behaviors of a physical textile or fabric.

As used herein, the term "edge" when applied to a textile or fabric refers to border where the textile or fabric terminates. The term "edge rolling indicator" refers to a graphical indicator that indicates how a textile or fabric will roll along an edge. The term "folding indicator" refers to a graphical indicator that indicates how a fabric will fold at a location other than an edge.

According to another aspect of the subject matter described herein, receiving graphical input from the user regarding the knit pattern, stitch geometry, and stitch type includes receiving input from the user regarding knit and purl stitches to be included in the textile or fabric design.

According to another aspect of the subject matter described herein, applying the edge rolling and/or folding indicators includes applying the indicators to non-oblique oriented edges of blocks of knit and purl stitches.

According to another aspect of the subject matter described herein, applying the edge rolling and/or folding indicators comprises applying the edge rolling indicators to edges of blocks of knit and purl stitches that are oriented at oblique angles with respect to a course or wale direction and applying the folding indicators at non-oblique angles with respect to the course or wale direction along longest continuous segments of knit or purl stitches.

According to another aspect of the subject matter described herein, applying the edge rolling and/or folding indicators includes automatically applying the edge rolling and/or folding indicators using rules for placement of the edge rolling and/or folding indicators.

According to another aspect of the subject matter described herein, applying the edge rolling and/or folding indicators includes receiving user input for graphically placing the edge rolling and/or folding indicators on the displayed pattern.

According to another aspect of the subject matter described herein, the method for designing a textile or fabric includes determining scaled dimensions of the at least one block according to measured or predicted forces driving edge rolling and/or folding behavior.

According to another aspect of the subject matter described herein, the method for designing a textile or fabric includes graphically displaying the pattern including the at least one block scaled according to the determined scaled dimensions.

According to another aspect of the subject matter described herein, a system for designing a knitted textile or fabric is provided. The system includes a computing platform including at least one processor and a memory. The system further includes a fabric design tool comprising computer executable instructions stored in the memory and executable by the at least one processor for receiving graphical input from a user regarding a knit pattern comprised of different types of individual stitches to be included in a textile or fabric design, graphically displaying a representation of the textile or fabric design, merging sections of continuous stitches of the same type into at least one block, graphically displaying the textile or fabric design as a pattern of the at least one block, applying edge rolling and/or folding indicators to the displayed pattern of the at least one block, where the edge rolling and/or folding indicators respectively and graphically illustrate predicted edge rolling and folding behaviors of a physical textile or fabric.

According to another aspect of the subject matter described herein, a non-transitory computer readable medium having stored thereon executable instructions that when executed by the processor of a computer control the computer to perform steps is provided. The steps include receiving graphical input from a user regarding a knit pattern comprised of different types of individual stitches to be included in a textile or fabric design. The steps further include graphically displaying a representation of the textile or fabric design. The steps further include merging sections of continuous stitches of the same type into at least one block. The steps further include graphically displaying the textile or fabric design as a pattern of the at least one block. The steps further include applying edge rolling and/or folding indicators to the pattern of the at least one block. The steps further include scaling a graphical representation of the pattern based on measured or predicted forces on the pattern. The steps further include graphically displaying a scaled representation of the pattern to illustrate predicted edge rolling and folding behaviors of a physical textile or fabric.

The subject matter described herein can be implemented in software in combination with hardware and/or firmware. For example, the subject matter described herein can be implemented in software executed by a processor. In one exemplary implementation, the subject matter described herein can be implemented using a non-transitory computer readable medium having stored thereon computer executable instructions that when executed by the processor of a computer control the computer to perform steps. Exemplary computer readable media suitable for implementing the subject matter described herein include non-transitory computer-readable media, such as disk memory devices, chip memory devices, programmable logic devices, and application specific integrated circuits. In addition, a computer readable medium that implements the subject matter described herein may be located on a single device or computing platform or may be distributed across multiple devices or computing platforms.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

Examples and implementations of the subject matter described herein will now be explained with reference to the accompanying drawings, of which:

FIGS. 5-7 are tables illustrating rules that may be used by the fabric design tool for placing edge rolling and folding indicators onto graphical representations of knit fabrics. In particular, FIG. 5 illustrates rules for placing edge rolling or folding indicators on fabrics with knit and purl stitch patterns oriented at non-oblique angles with regard to the course and wale directions. FIG. 6 illustrates rules for placing edge rolling indicators on fabrics with knit and purl stitch patterns oriented at oblique angles with regard to the course and wale directions. FIG. 7 illustrates rules for placing edge rolling and folding indicators on fabrics to indicate mountain and valley folds on fabrics with knit and purl stitch patterns oriented at non-oblique angles with regard to the course and wale directions;

FIGS. 12A and 12B illustrate an example where the fabric design tool is applied to a stitch pattern that is different on the front and back side;

FIG. 13 is a diagram illustrating application of the fabric design tool to a stitch pattern that has knit to purl transitions at oblique angles;

FIG. 20 also illustrates a physical fabric corresponding to the graphical representation;

DETAILED DESCRIPTION

According to one aspect of the subject matter described herein, a software-implemented tool is provided that graphically displays to a user representations of knit and purl stitches, allows the user to build a virtual textile or fabric design using the stitches, and, based on the arrangement of the stitches, predicts the edge rolling and folding behaviors of a physical textile or fabric design having the same stitch patterns as the virtual textile or fabric design.

In one implementation, the tool is created in Adobe Illustrator and enables a user to design a fabric and predict edge rolling and folding behaviors though the following process.

Figure 1:
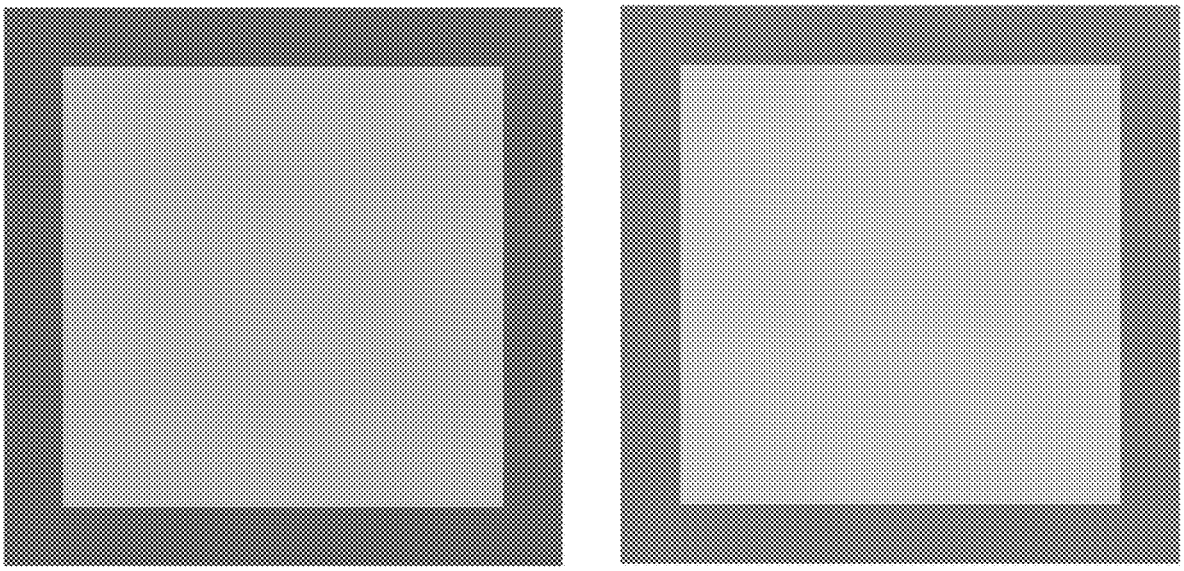
FIG. 1 is a diagram illustrating graphical representations of knit and purl stitches that may be displayed by a fabric design tool.

Step 1) Blocks representing knit and purl are used to represent the stitches in the knit pattern. These blocks are displayed by the tool to the user, and examples of such blocks are illustrated in FIG. 1. In FIG. 1, the block on the left side (shown in pink) represents a single knit stitch, and the block on the right side (shown in blue) represents a single purl stitch.

Figure 2:
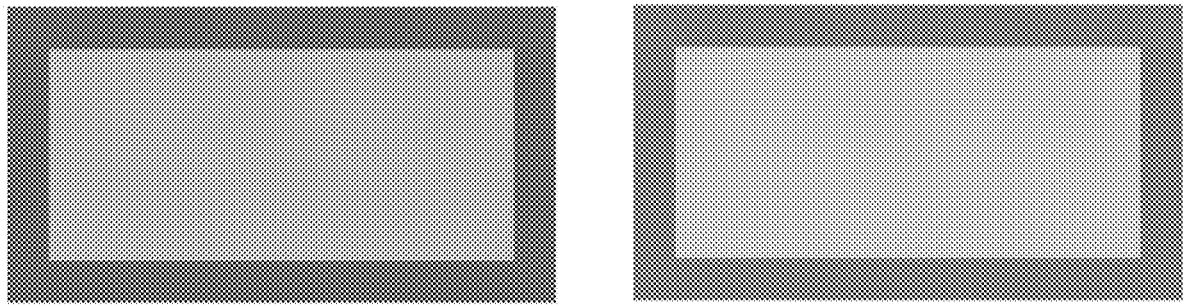
FIG. 2 is a diagram illustrating graphical representations of knit and purl stitches scaled according to dimensions of a fabric gauge sample that may be displayed by the fabric design tool.

The tool scales the dimension of these blocks to reflect the real stitch dimensions, using a measured fabric gauge, via the equation:

$$A = \frac{\text{stitches per inch, course direction}}{\text{stitches per inch, wale direction}}$$

Where A is the aspect ratio of the stitch dimensions. The width of the pattern block is then multiplied by A, to produce the scaled stitch representation blocks. FIG. 2 illustrates an example of scaled stitch representation blocks where A=2.

Please note: Knit and purl stitches are structurally symmetrical (i.e., the back of knit stitch is a purl stitch, and the back of a purl stitch is a knit stitch.) The side from which they are viewed determines their nomenclature and appearance.

Figure 3:
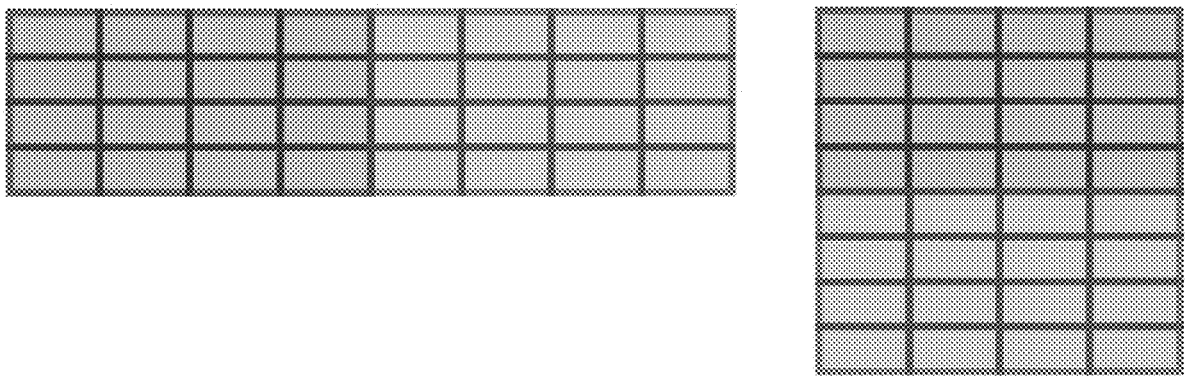
FIG. 3 is a diagram illustrating graphical representations of patterns of knit and purl stitches that may be displayed by the fabric design tool.

Step 2) Next, the user creates their knit and purl stitch pattern by laying out these building blocks in the desired pattern. FIG. 3 illustrates an example where two simple patterns are created, one in which a cluster of knit stitches is placed next to a cluster of purl stitches and one in which a cluster of knit stitches is placed above a cluster of purl stitches.)

Figure 4:
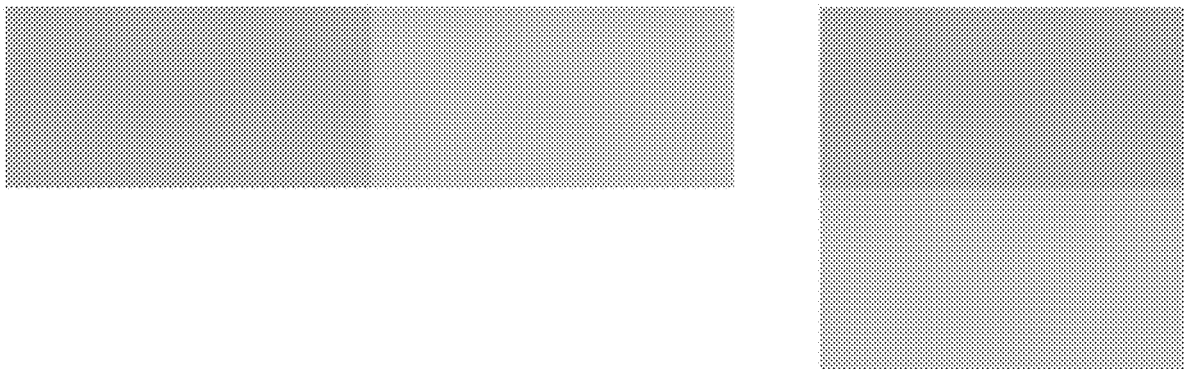
FIG. 4 is a diagram illustrating graphical representation of the stitch patterns in FIG. 3 where the individual stitches are merged by the fabric design tool into sections of fabric with the same stitch type.

Step 3) The tool then merges any continuous sections of knit or purl stitches into blocks of knit segments and purl segments. FIG. 4 illustrates the virtual fabric designs from FIG. 3 where the individual stitches of each type are merged into blocks of stitches of the same type. In FIG. 4, the stitches from FIG. 3 are merged into larger rectangular sections of knit and purl stitches, replacing the individual stitch representations and removing their shape outlines.

Step 4) Next the user would apply edge rolling indicators and folding indicators by adhering to the rules set forth in the tables illustrated in FIGS. 5-7.

Figure 8:
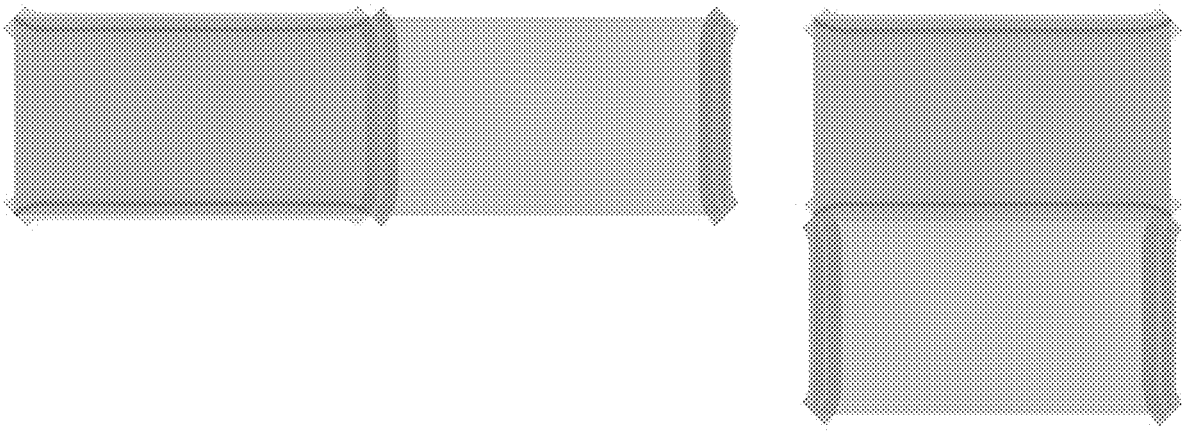
FIG. 8 is a diagram illustrating a graphical representation of a fabric with edge rolling and folding indicators placed on fabric edges and stitch boundaries that may be displayed by the fabric design tool.

All edge rolling indicators will be placed such that the small curves at the edge perfectly intersect the corner of the knit or purl segment, and then the linear segment is scaled to fully connect the top and bottom or left and right sides of the edge rolling indicator. FIG. 8 illustrates the edge rolling and folding indicators added to the virtual fabric illustrated in FIG. 4. Edge rolling indicators show where the knit segment will curl over the purl segment (thus increasing the pink surface area and decreasing the blue surface area) and where the purl segment will curl over the knit segment (thus increasing the blue surface area and decreasing the pink surface area).

Step 5) Scale the pattern pieces, according to experimentally measured or predicted horizontal vs vertical knit to purl transition folding force ratios, if available. (The ratio of force required to unroll a horizontal vs. vertical knit to purl stitch transition) The knit or purl segment blocks are scaled to reflect the magnitude of forces driving deformation and folding behaviors. First the equation below is applied;

$$R = \frac{F_H}{F_V}$$

Where the required force to start unrolling a horizontal knit to purl transition is $F_H$ is and the required force to start unrolling a vertical knit to purl transition is $F_v$, and R is the ratio of horizontal to vertical folding.

This ratio is then applied to purl segments to scale, multiplying the height of the segment by R, to produce a modified segment that more accurately reflects the level of deformation that causes the purl to curl over the knit at horizontal boundaries. The scaling ratio is applied in this way to reflect the experimentally determined fact that proportionally, folding at horizontal knit to purl transitions is always stronger than folding at vertical knit to purl transitions.

Figure 9:
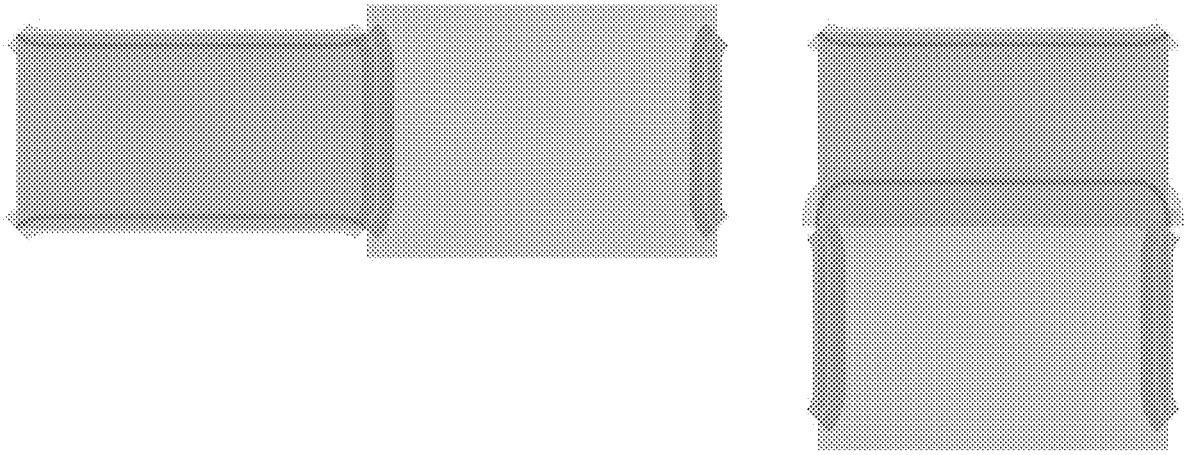
FIG. 9 illustrates results of scaling the virtual fabric designs in FIG. 8 by the fabric design tool to reflect predicted forces driving deformation and folding behaviors based on the edge rolling and folding indicators.

The edge rolling indicators and folding indicators are adjusted also, such that their end points remain tethered to their original location and the linear segment moves in unison with the underlying pattern piece. The curve of the end pieces then adjusts to join back into the linear segment. FIG. 9 illustrates results of scaling the virtual fabric designs in FIG. 8 to reflect predicted forces driving deformation and folding behaviors.

This tool demonstrates a representation of the self-folding behavior of one face of the fabric at a time. In cases where the knit and purl stitch pattern is symmetrical, only one face needs to be mapped to understand the resulting behavior of both sides of the fabric (such as in "Example of Tool Applied_Pattern #1" and "Example of Tool Applied_Pattern #3") (described below). In other cases, both faces of the fabric need to be mapped separately in order to understand the resulting behavior of both the front and back of the fabric (such as in "Example of Tool Applied_Pattern #2").

Step 4) in the Case of Patterns with Angles Other than 0 or 90 (Oblique Angles)

In step 4 above, the user applies horizontal and vertical edge rolling indicators to a virtual fabric. The tool described herein also allow predicting of fabric edge rolling and folding behaviors for cases where the edge rolling indicators are applied at oblique angles, such as where knit and purl stitches meet on at 45 degree boundary in a virtual fabric. Again, the user would apply edge rolling indicators and then delineate the folding indicators by adhering to the rules laid out in the tables in FIGS. 5-7.

Figure 10:
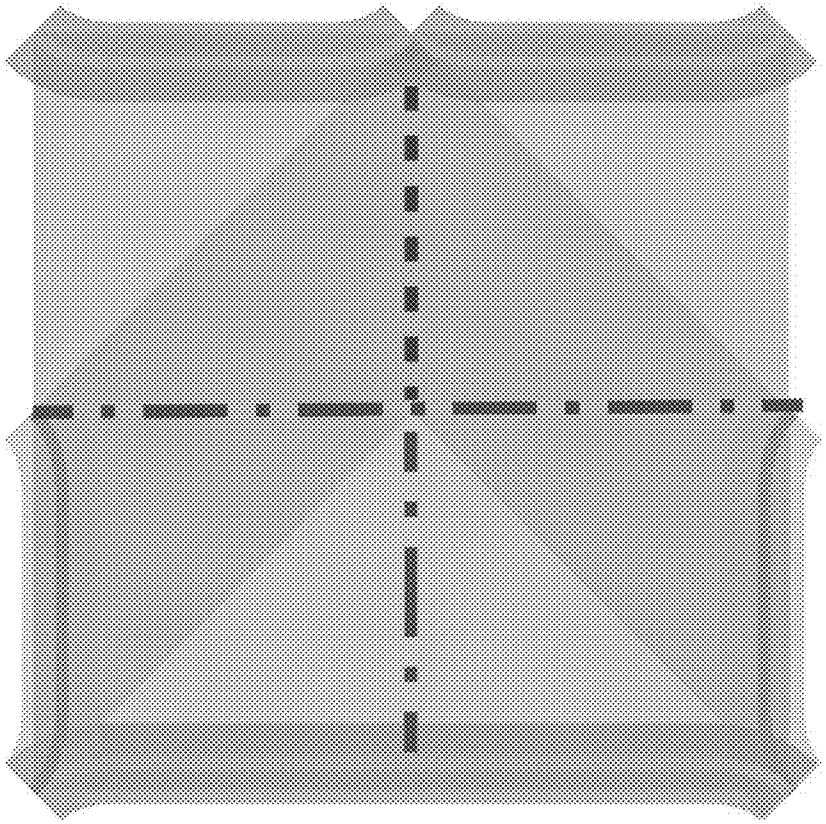
FIG. 10 illustrates an example of a virtual fabric that may be displayed by the fabric design tool where borders between knit and purl stitch patterns form oblique angles with respect to the course direction.

Mountain fold indicators demonstrate where the fabric will fold upwards. Valley fold indicators demonstrate where the fabric will fold downwards. FIG. 10 illustrates an example of a virtual fabric where border between knit and purl stitch patterns form oblique angles.

The following examples illustrate application of the tool to various stitch patterns.

Example #1 of The Tool Applied to a Knit and Purl Stitch Pattern

Figure 11:
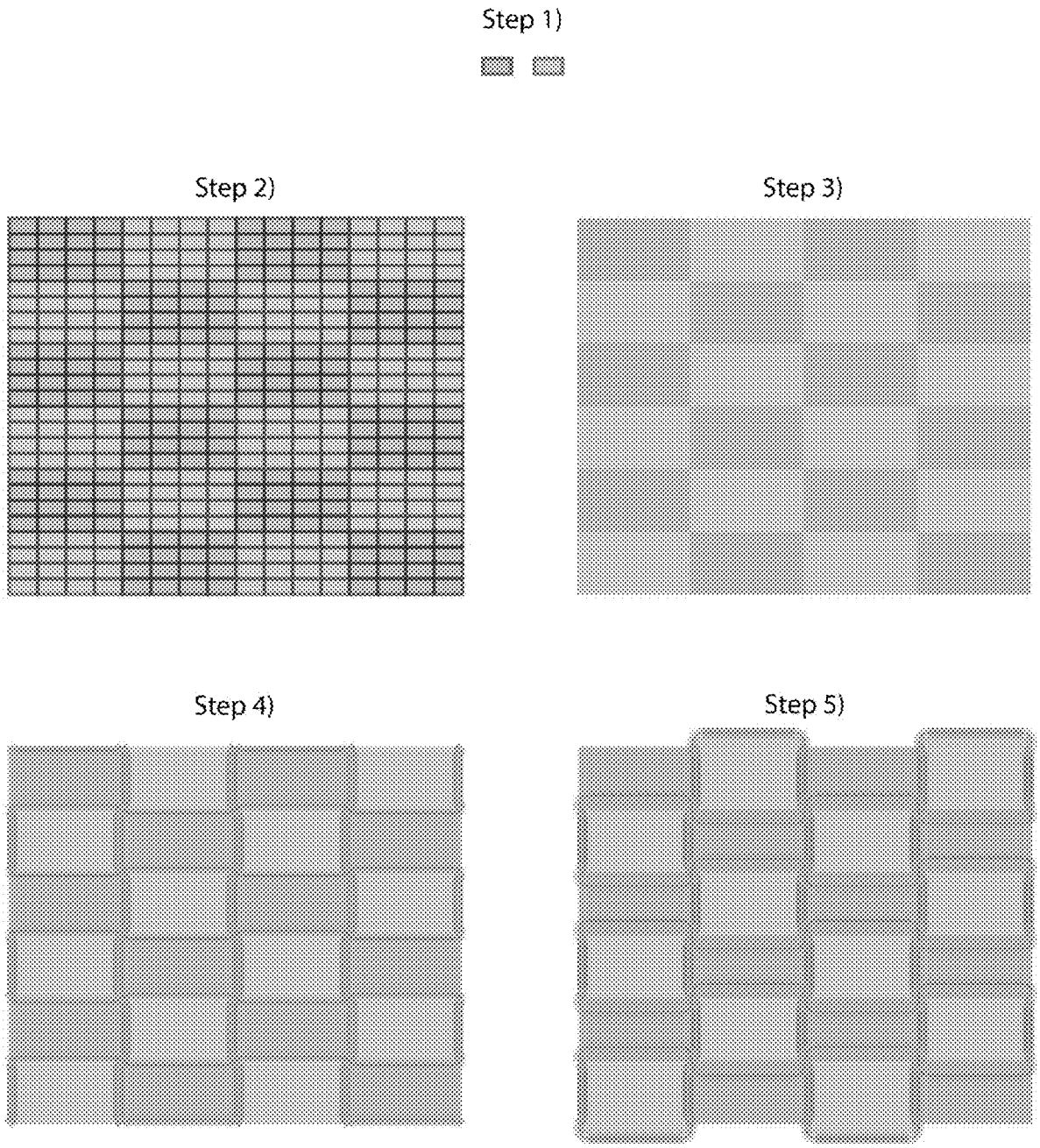
FIG. 11 is a diagram illustrating exemplary steps that may be performed by or using the fabric design tool for designing a fabric and predicting deformation and folding behaviors.

The application of the tool to a virtual fabric with only horizontal and vertical transitions is shown in FIG. 11. The steps in FIG. 11 correspond to those described above with regard to FIGS. 1-10.

Example #2 of The Tool Applied to a Knit and Purl Stitch Pattern

FIGS. 12A and 12B illustrate an example where the tool is applied to a virtual fabric with a stitch pattern that is different on the front and back side (i.e., with more knit visible on front, more purl visible on back), the different folding behaviors are shown on each side. The steps in FIGS. 12A and 12B correspond to those described above with regard to FIGS. 1-10.

Example #3 of The Tool Applied to a Knit and Purl Stitch Pattern

FIG. 13 illustrates application of the fabric design tool to a stitch pattern that has knit to purl transitions at oblique angles. The steps in FIG. 13 correspond to those described above with regard to FIGS. 1-10. Please note that Step 5 is not illustrated in FIG. 13.

Self-folding occurs as a result of boundary condition behaviors in knit and purl stitch transitions. The folding behavior in the horizontal knit to purl transitions is dominant over the folding behavior in the vertical knit to purl transitions regardless of the fabrication parameters used to produce the fabric.

Figure 14:
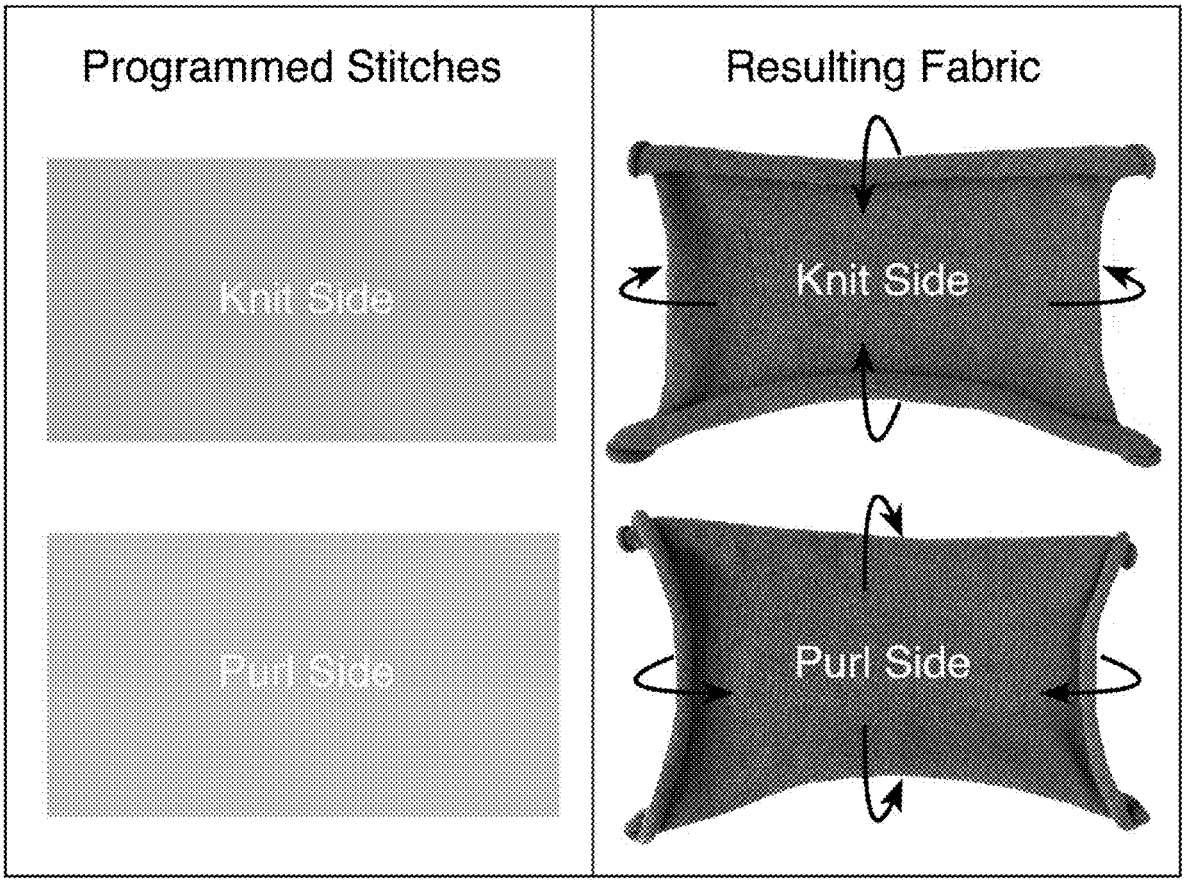
FIG. 14 is a diagram illustrating programmed stitches (i.e., those generated using the fabric design tool) and a corresponding physical plain knit fabric, including the knit side and the purl side.

To begin to understand the self-folding behavior of complex knit and purl stitch structures, it is necessary to first observe the plain weft knit fabric, that is, one made of all knit stitches on the technical front and all purl stitches on the technical back. A characteristic edge rolling behavior occurs in all plain knit fabrics, regardless of material or method of manufacture. An example of a plain knit fabric is shown in FIG. 14, as viewed from the knit side and the purl side. The characteristic behavior is shown, and, as viewed from the knit side of the fabric, can be described by the tendency of the top and bottom edges to always curl towards the front (towards the knit side) and the tendency of the side edges to always curl towards the back (towards the purl side).

Figures 15A, 15B:
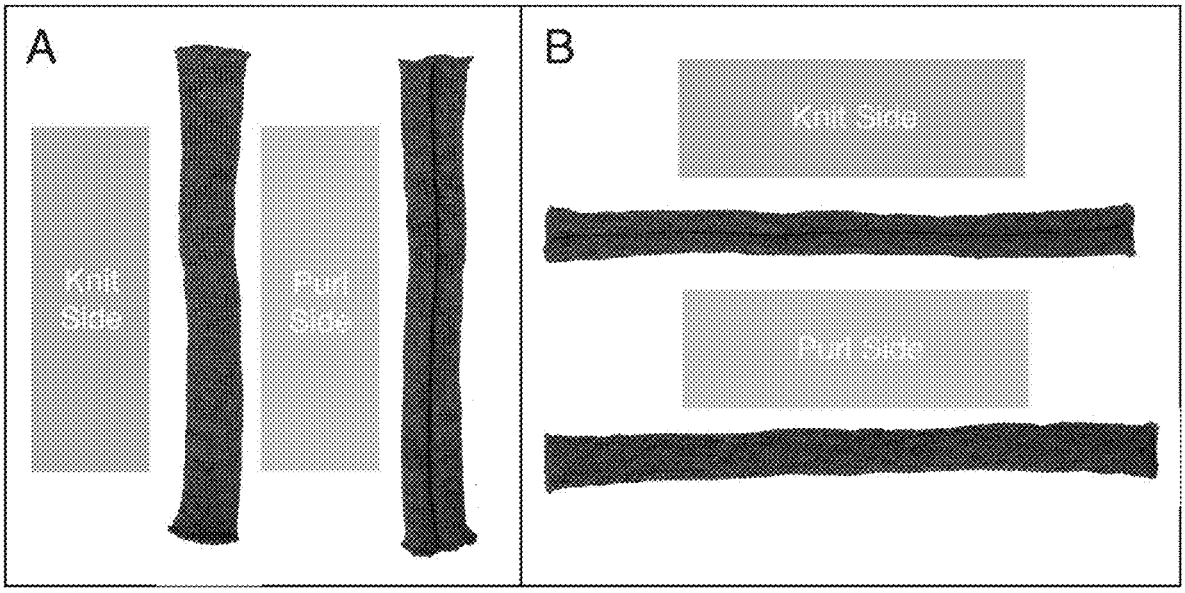
FIGS. 15A and 15B are diagrams of programmed stitches and physical plain knit fabrics wherein in FIG. 15A, the number of courses is greater than the number of wales and, in FIG. 15B, the number of wales is greater than the number of courses.

This effect is magnified in one direction when a fabric is produced where the number of courses far exceeds the number of wales, or vice-versa. FIG. 15A shows sample of plain knit fabric where the number of courses greatly exceeds the number of wales. Due to this imbalance, the curling effect on the side edges completely overtakes the curling effect on the top and bottom edges, and the entire fabric is deformed into a scroll shape. Only knit stitches can be seen as the knit side is completely curled towards the purl side. If on the other hand, the number of wales greatly exceeds the number of courses, the opposite effect is observed. The entire fabric is deformed into a scroll shape consisting of the purl side curling completely towards the knit side (FIG. 15B).

Figure 16:
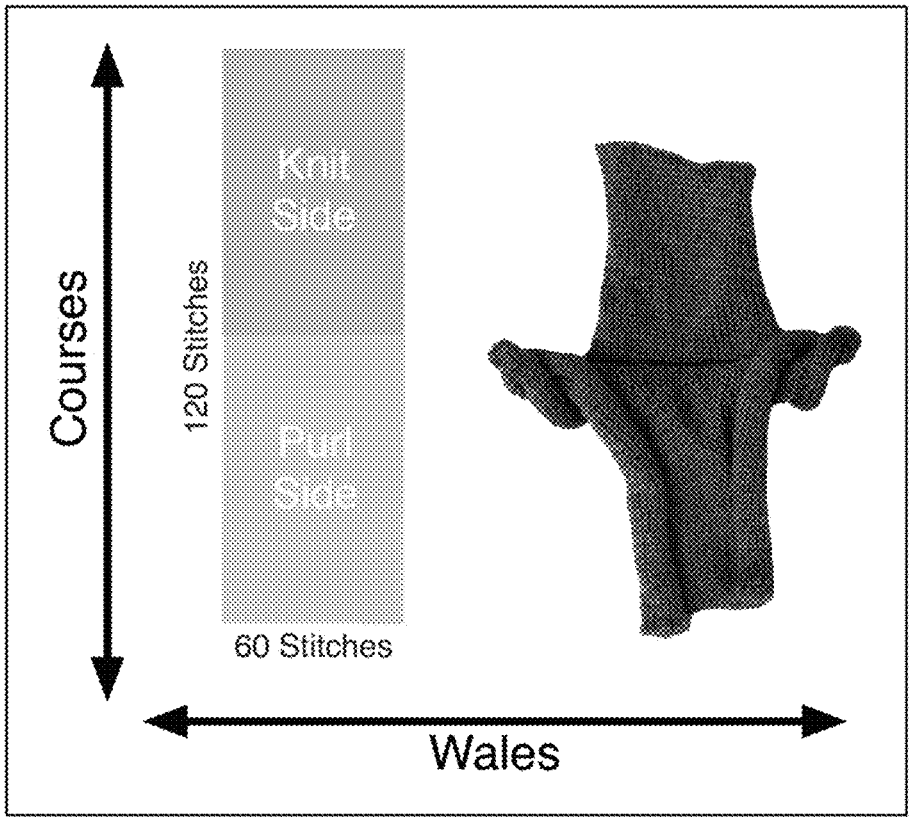
FIG. 16 is a diagram of programmed stitches and a corresponding physical fabric where the number of courses is 120 and the number of wales is 60.

By understanding these fundamental behaviors of plain knit segments, it can then be demonstrated that behavior of all knit and all purl segments, when added together into a single side of a fabric, produce dimensional changes at the boundaries through interacting edge rolling behaviors. These result in out of plane deformation, or "folding". FIG. 16 depicts a fabric sample that is 60 wales by 120 courses. The first 60 courses are produced using the purl stitch and the second 60 courses are produced using the knit stitch. Considering the knit boundary condition behaviors described above, in the middle of this fabric the stitches transition from purl to knit. The top edge of the purl segment curls backwards, and the bottom edge of the knit segment curls forwards. The resulting fabric exhibits a new kind of rolling behavior in the horizontal transition zone between knit and purl.

Figure 17:
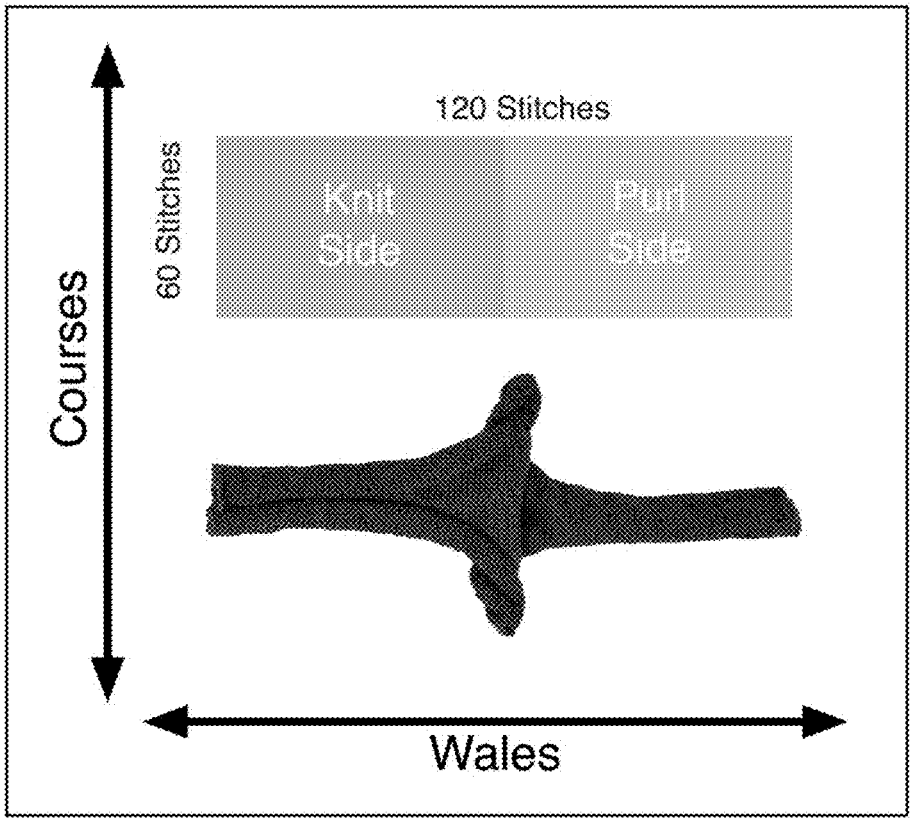
FIG. 17 is a diagram of programmed stitches and a corresponding physical fabric where the number of courses is 60 and the number of wales is 120.

Similar behavior occurs with a vertically oriented boundary between knit and purl. FIG. 17 depicts a fabric sample that is 120 wales by 60 courses. The first 60 wales are produced using knit stitches, and the second 60 wales are produced using purl stitches. Here, the resulting fabric exhibits a similar rolling behavior occurring in the vertical transition zone between knit and purl.

As previously described, all knit and purl structures can be created at the individual stitch level by transitioning horizontally or vertically between knit and purl stitches on the same side of the fabric.

Figure 18:
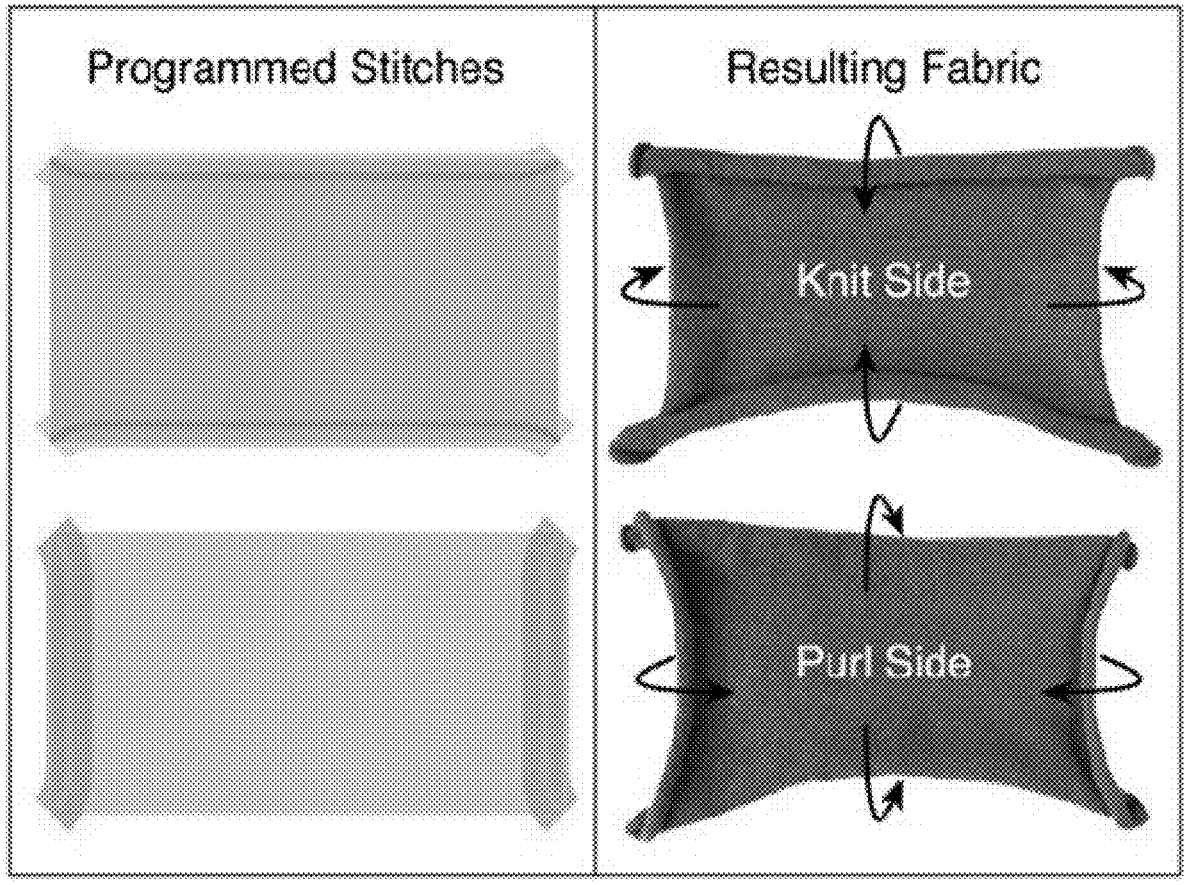
FIG. 18 is a diagram illustrating characteristic edge deformation behaviors of plain knit fabrics using a fabric design to predict fabric behaviors for a knit side and a purl side of a fabric.

Using these concepts, the developed modular tool for design of self-folding knit fabrics can be used to predict the directions of the folds and how they interact to produce more complex behaviors such as torque. By understanding that the folding behavior occurs as a result of competition between boundary condition deformations, "puzzle pieces" were developed to diagrammatically represent the generalized behavior of segments of all knit or all purl stitches. These puzzle pieces represent an all knit or all purl segment with its appropriate curling behavior at the side, top or bottom edge using saddle shape geometries to represent boundary conditions (FIG. 18). In the case of knit segments, the puzzle piece indicates that the segment will curl forward at the top and bottom edges and backwards at the side edges. In the case of purl segments, the puzzle piece indicates that the segment will curl backwards at the top and bottom edges and forwards at the side edges. In both instances, by looking at the corners of each representation, we can also see the direction of twist that will occur in each instance. These corners indicate how the behaviors of the individual segments will interact.

Figures 19A, 19B:
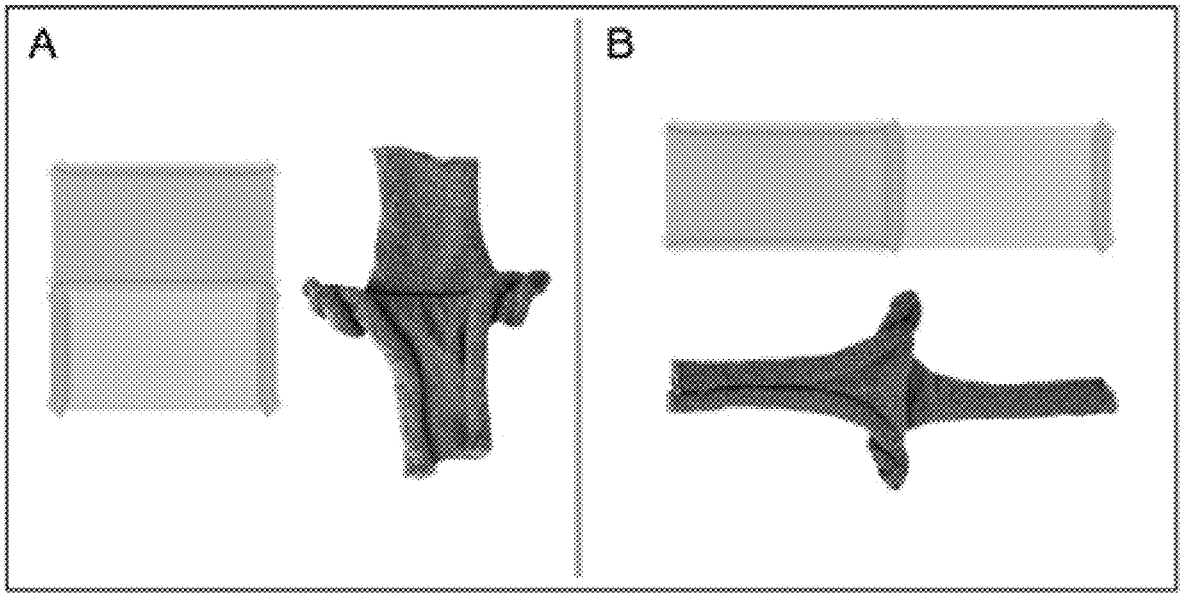
FIGS. 19A and 19B are graphical representations of stitch patterns with folding indicators that may be created using the fabric design tool and the corresponding physical fabric behavior.

These modeling pieces can be rescaled as needed, according to the particular stitch pattern used. When these pieces are fit together, such as in a horizontal or vertical transition from knit to purl, they clearly indicate the direction of folding that occurs in the real textile samples (FIGS. 19A and 19B). In the case of horizontal transition between knit and purl (FIG. 19A) these segments show how the purl segment will curl over the knit, as well as the direction of torque that occurs at each edge.

Figure 20:
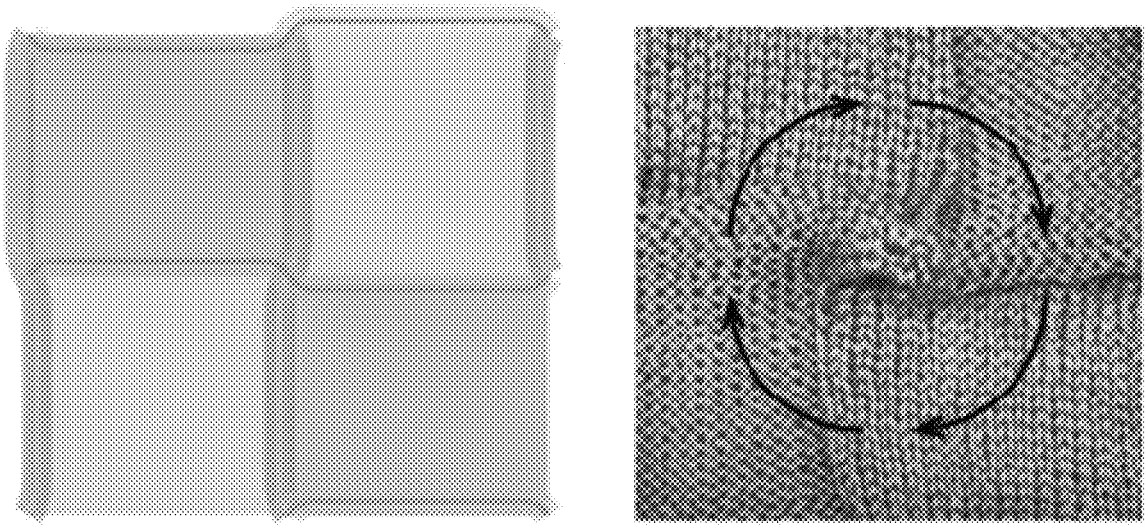
FIG. 20 is a diagram illustrating a graphical representation of a stitch pattern with horizontal and vertical transition folds produced using the fabric design tool.

By mapping these pieces over increasingly complex stitch patterns, more complex behaviors can be understood before manufacturing. A checkerboard pattern of knit and purl segments, as seen in FIG. 20, shows how torque is created in the middle of the fabric, pushing the center point up and out of the plane. The specific direction of this rotation is indicated by the diagrammatic tool, observed through the interaction of the corners of each knit or purl puzzle piece.

Figure 21:
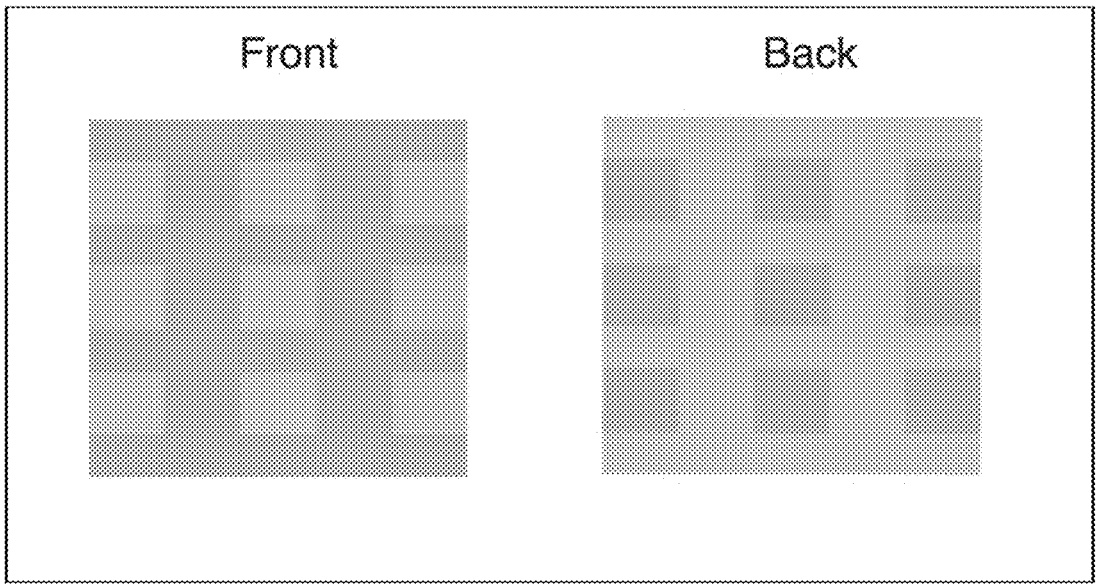
FIG. 21 is a diagram illustrating graphical representations of knit and purl stitch patterns produced using the fabric design tool.
Figure 22:
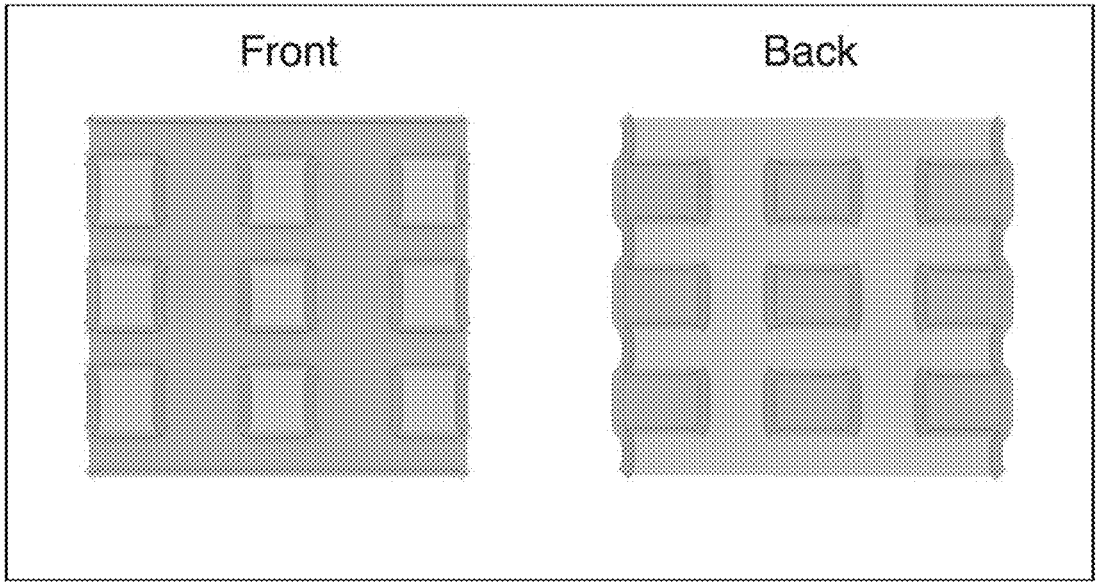
FIG. 22 is a diagram illustrating graphical representations of the effect of the stitch patterns illustrated in FIG. 21.
Figure 23:
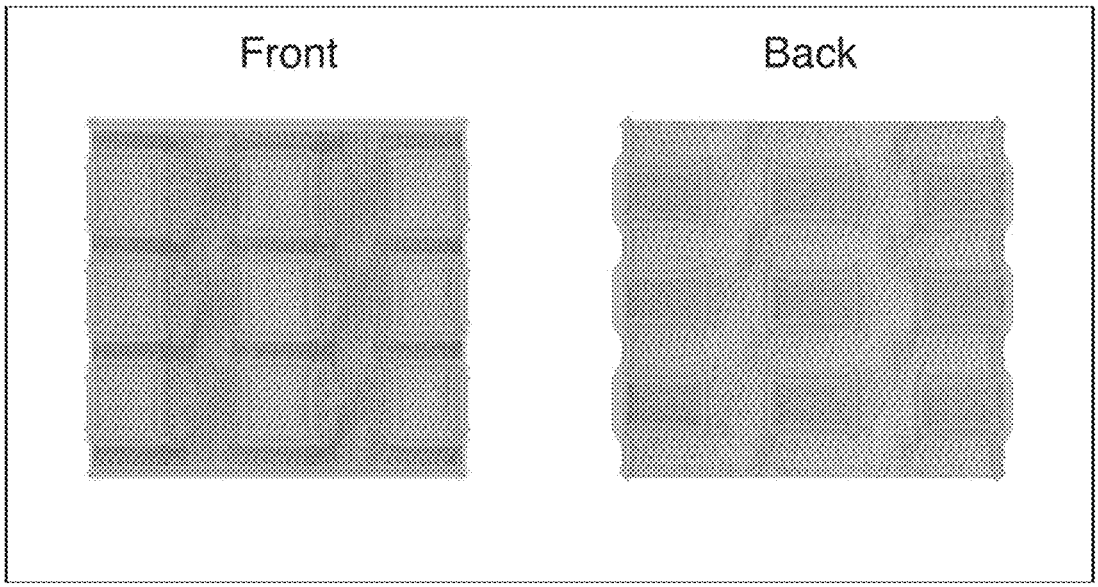
FIG. 23 is a diagram illustrating an overlay of the graphical representations illustrated in FIG. 22 on front and back sides of a physical stretched fabric.
Figure 24:
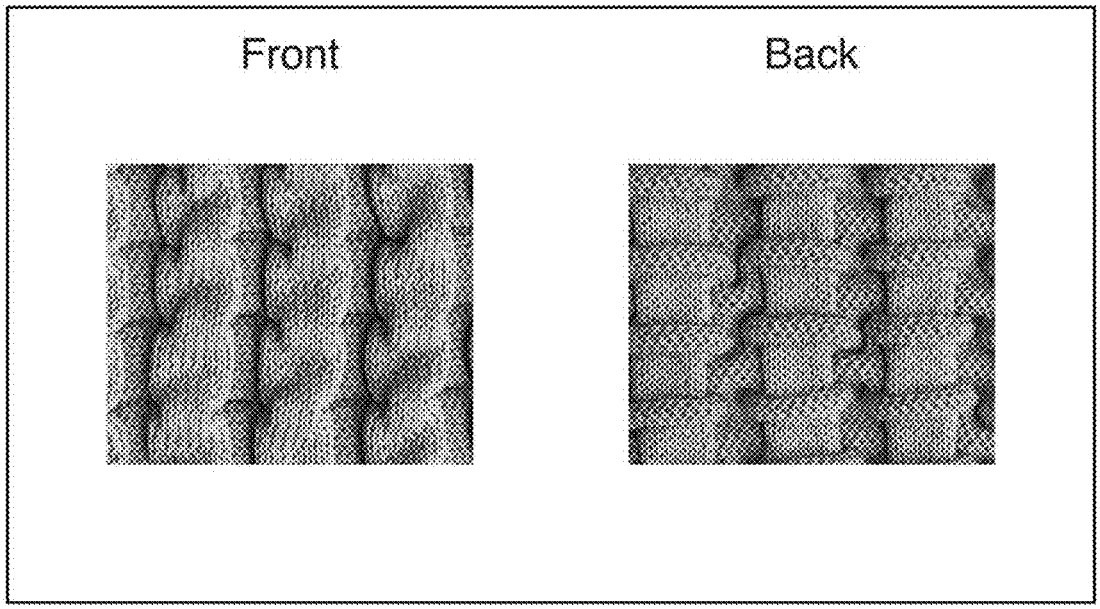
FIG. 24 is a diagram illustrating front and back sides of relaxed fabric produced using the stitch pattern of FIG. 21.

Additional information regarding how different planes of the fabric will form is also indicated. The series of FIGS. 21-24) show the puzzle pieces applied to a different knit and purl stitch pattern, and the resulting fabric that is formed. Starting with a knit and purl stitch pattern (FIG. 21), the puzzle pieces can be applied for both the front and the back of the sample. Observing the resulting diagram that is produced, the directions of the folds are shown. This mapping pattern can be overlaid with the real fabric held in tension, to confirm the correspondence of the segments (FIG. 23), and then when the fabric has relaxed, to confirm the dimensionality that was predicted (FIG. 24).

To further increase the accuracy in prediction of specific folding behaviors described above, mechanical characterization data can be incorporated, if available, into the tool. This allows the user to predict how the ratio of physical folding forces in the horizontal and vertical directions between knit and purl will affect the resulting fabric. This ratio will differ based on a variety of manufacturing parameters such as yarn material, and machine gauge. This ratio can be determined by measuring the forces required to unfold samples with isolated horizontal knit to purl transitions and comparing with the forces required to unfold samples with isolated vertical knit to purl transitions, when proportionally equivalent samples are produced. Specific methods for measuring these horizontal to vertical folding forces can be found in Chapter 5, Sections 5.3-5.6 of the above-referenced provisional patent application. Further details on how to predict the ratio of horizontal to vertical folding forces without excessive sample testing are detailed in Chapter 7, Section 7.3 of the above-referenced provisional patent application.

Exemplary Computer Implementation

Figure 25:
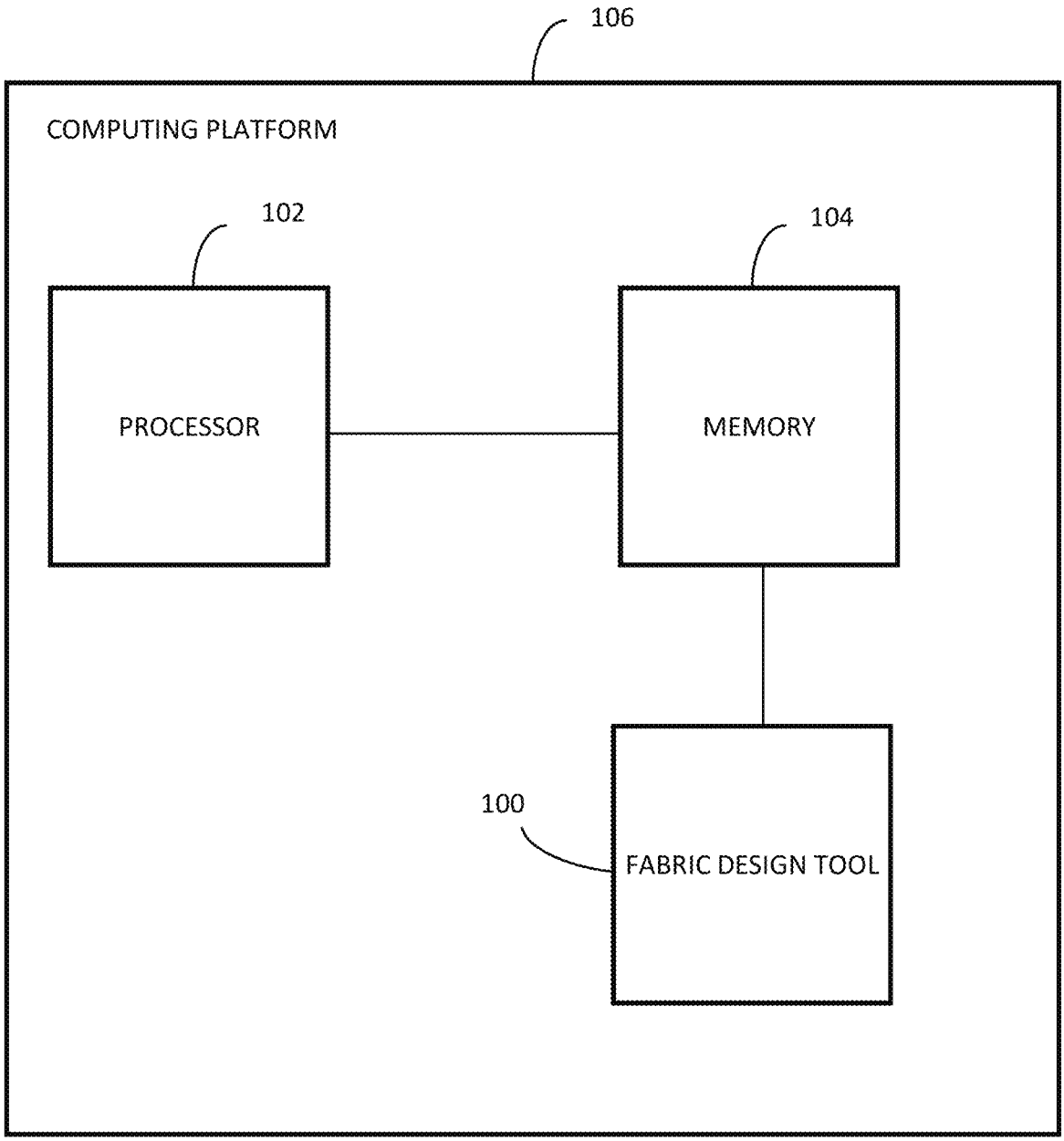
FIG. 25 is a block diagram illustrating an exemplary fabric design tool implemented on a computing platform.

FIG. 25 is a block diagram illustrating an exemplary computer implementation of the fabric design tool described herein. Referring to FIG. 25, a fabric design tool 100 may be implemented using computer executable instructions stored in memory 102 and executed by processor 104 of computing platform 106. In one example, computing platform 106 may be a general purpose computing platform, such as a personal computer, a tablet, or a mobile phone. and fabric design tool 100 may be an application program that executes on computing platform 106. In another example, computing platform 106 may be a server, and fabric design tool may be an application that executes on the server to allow users to design fabrics over a network interface, such as a web interface.

Figure 26:
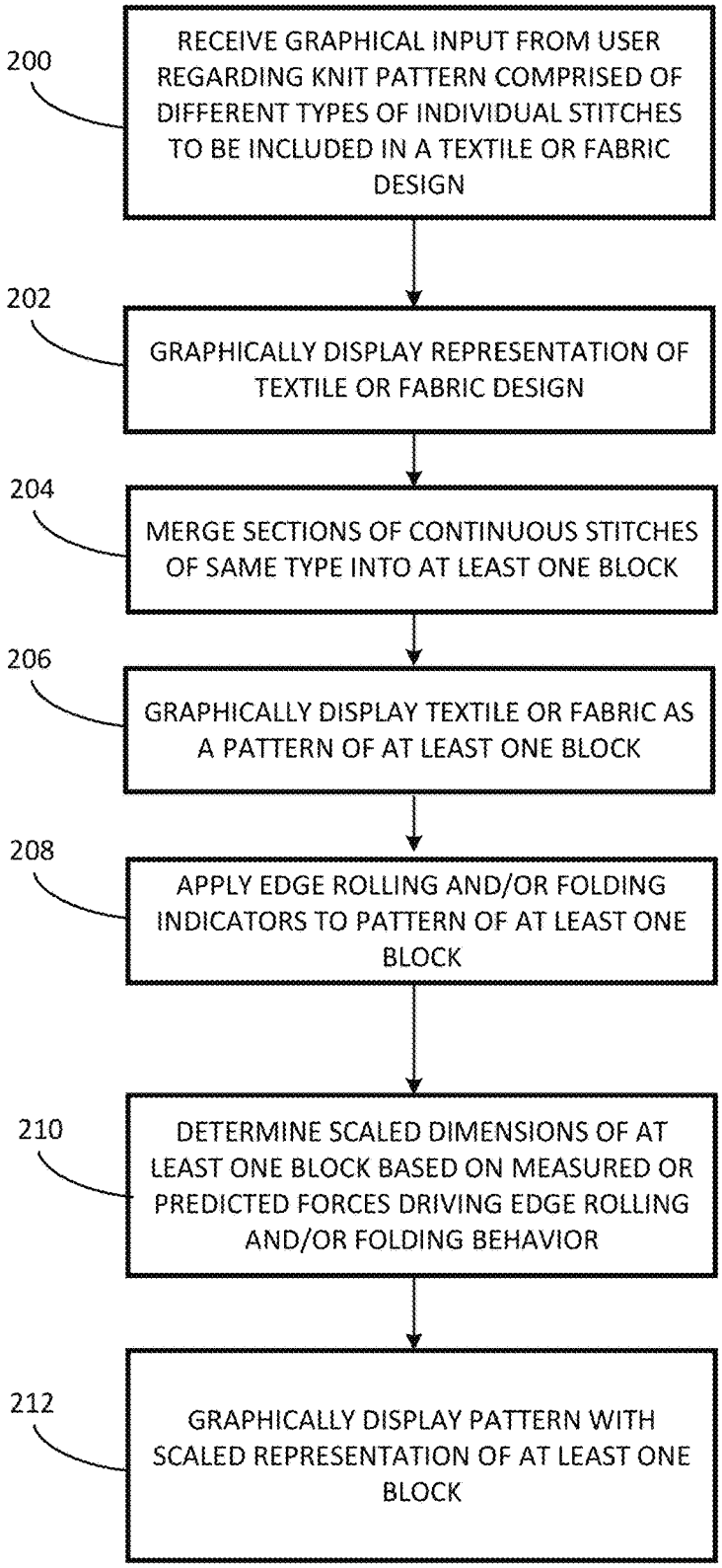
FIG. 26 is a flow chart illustrating an exemplary process for using a fabric design tool to predict fabric folding behaviors.

FIG. 26 is a flow chart illustrating exemplary steps for designing a fabric using fabric design tool 100. Referring to FIG. 26, in step 200, the process includes receiving graphical input from a user regarding a knit pattern comprised of different types of individual stitches (such as knit and purl) to be included in a textile or fabric design. For example, fabric design tool 100 may allow the user to input stitch patterns, such as those illustrated in FIG. 3.

In step 202, the process includes graphically displaying a representation of the textile or fabric design. For example, fabric design tool 100 may display a graphical representation of stitch patterns selected by the user. An example of such a display is illustrated in FIG. 3.

In step 204, the process includes merging sections of continuous stitches of the same type into at least one block. For example, fabric design tool 100 may merge continuous stitches of the same type into blocks. Even though the term "blocks" is used, blocks of continuous stitches may be any geometric shape corresponding to the continuous stitch patterns in the fabric.

In step 206, the process includes graphically displaying the textile or fabric design as a pattern of the at least one block. FIG. 4 illustrates an example where the graphical display includes a block of knit stitches and a block of purl stitches.

In step 208, the process includes applying edge rolling and/or folding indicators to the displayed pattern of the at least one block. For example, fabric design tool 100 may, in one example, automatically add edge rolling and/or folding indicators to the edges and transitions between sections of different types of stitches using the rules in the tables in FIGS. 5-7. In another example, fabric design tool 100 may display the rules in the tables in FIGS. 5-7 to the user and allow the user to add the edge rolling and folding indicators to the graphical representation of the pattern. FIG. 8 illustrates an example of a graphical representation of a fabric with edge rolling and folding indicators added to the edges and the transition between stitch patterns in the fabric.

In step 210, the process includes determining scaled dimensions of the at least one block based on measured or predicted forces driving edge rolling and/or folding behavior. For example, fabric design tool 100 may predict the edge rolling and folding on the at least one block using the equations described herein and use the measured or predicted forces (magnitudes and directions) to determine the scaling to be applied to the blocks of stitches illustrated in the graphical representation of the textile or fabric. In another example, fabric design tool 100 may use stored measurements of forces from physical fabrics to determine the forces to be used in calculating the scaling to be applied to the dimensions of the displayed fabrics.

In step 212, the process includes graphically displaying the pattern including the scaled representation of the at least one block. For example, fabric design tool 100 may determine scaled display a scaled graphical representation of the textile or fabric, such as the representation illustrated in FIG. 9, which illustrates predicted edge rolling and folding behaviors of a physical textile fabric.

It will be understood that various details of the subject matter described herein may be changed without departing from the scope of the subject matter described herein. Furthermore, the foregoing description is for the purpose of illustration only, and not for the purpose of limitation, as the subject matter described herein is defined by the claims as set forth hereinafter.

What is claimed is:

1. A method for designing a knitted textile or fabric, the method comprising:

displaying, to a user, blocks representing individual stitches;

receiving graphical input from the user regarding a knit pattern comprised of different types of individual stitches to be included in a textile or fabric design, wherein receiving graphical input includes allowing the user to graphically lay out the blocks in a desired pattern;

graphically displaying the desired pattern as a grid of the blocks;

selecting edge rolling indicators and/or folding indicators based on stitch pattern conditions of the displayed pattern and a plurality of rules that specify edge rolling and/or folding indicators for different stitch pattern conditions, where the stitch pattern conditions include orientations of edges of segments of stitches of a given type and orientations of boundaries between segments of stitches of different types; and applying the selected edge rolling indicators and/or folding indicators to the displayed pattern, wherein the edge rolling and/or folding indicators respectively and graphically illustrate predicted edge rolling and folding behaviors of a physical textile or fabric.

2. The method of claim 1 wherein receiving graphical input from the user regarding the knit pattern, stitch geometry, and stitch type includes receiving input from the user regarding knit and purl stitches to be included in the textile or fabric design.

3. The method of claim 1 wherein applying the edge rolling and/or folding indicators includes applying the edge rolling and/or folding indicators to edges of blocks of knit and purl stitches oriented at non-oblique angles with respect to a course or wale direction.

4. The method of claim 1 wherein applying the edge rolling and/or folding indicators comprises applying the edge rolling and/or folding indicators to edges of blocks of knit and purl stitches that are oriented at oblique angles with respect to a course or wale direction and applying the edge rolling and/or folding indicators at non-oblique angles with respect to the course or wale direction along longest continuous segments of knit or purl stitches.

5. The method of claim 1 wherein applying the edge rolling and/or folding indicators includes automatically applying the edge rolling and/or folding indicators using the rules.

6. The method of claim 1 wherein applying the edge rolling and/or folding indicators includes receiving user input for graphically placing the edge rolling and/or folding indicators on the displayed pattern.

7. The method of claim 1 comprising determining scaled dimensions of the displayed pattern according to measured or predicted forces driving edge rolling and/or folding behavior.

8. The method of claim 7 comprising scaling the displayed pattern according to the scaled dimensions.

9. A system for designing a knitted textile or fabric, the system comprising:

a computing platform including at least one processor and a memory; and a fabric design tool comprising computer executable instructions stored in the memory and executable by the at least one processor for displaying, to a user, blocks representing individual stitches, receiving graphical input from the user regarding a knit pattern comprised of different types of individual stitches to be included in a textile or fabric design, wherein receiving graphical input includes allowing the user to graphically lay out the blocks in a desired pattern graphically displaying the desired pattern as a grid of the blocks, selecting edge rolling indicators and/or folding indicators based on stitch pattern conditions of the displayed pattern and a plurality of rules that specify edge rolling and/or folding indicators for different stitch pattern conditions, where the stitch pattern conditions include orientations of edges of segments of stitches of a given type and orientations of boundaries between segments of stitches of different types, applying the selected edge rolling indicators and/or folding indicators to the displayed pattern, wherein the edge rolling and/or folding indicators respectively and graphically illustrate predicted edge rolling and folding behaviors of a physical textile or fabric.

10. The system of claim 9 wherein receiving graphical input from the user regarding the knit pattern, stitch geometry, and stitch type includes receiving input from the user regarding knit and purl stitches to be included in the textile or fabric design.

11. The system of claim 9 wherein applying the edge rolling and/or folding indicators includes applying the edge rolling and/or folding indicators to edges of blocks of knit and purl stitches oriented at non-oblique angles with respect to a course or wale direction.

12. The system of claim 9 wherein applying the edge rolling and/or folding indicators comprises applying the edge rolling and/or folding indicators to edges of blocks of knit and purl stitches that are oriented at oblique angles with respect to a course or wale direction and applying the edge rolling and/or folding indicators at non-oblique angles with respect to the course or wale direction along longest continuous segments of knit or purl stitches.

13. The system of claim 9 wherein applying the edge rolling and/or folding indicators includes automatically applying the edge rolling and/or folding indicators using the rules.

14. The system of claim 9 wherein applying the edge rolling and/or folding indicators includes receiving user input for graphically placing the edge rolling and/or folding indicators on the displayed pattern.

15. The system of claim 9 wherein the fabric design tool is configured to determine scaled dimensions of the displayed pattern according to measured or predicted forces driving edge rolling and/or folding behavior.

16. The system of claim 15 wherein the fabric design tool is configured to scale the displayed pattern according to the scaled dimensions.

17. A non-transitory computer readable medium having stored thereon executable instructions that when executed by a processor of a computer control the computer to perform steps comprising:

displaying, to a user, blocks representing individual stitches;

receiving graphical input from the user regarding a knit pattern comprised of different types of individual stitches to be included in a textile or fabric design, wherein receiving graphical input includes allowing the user to graphically lay out the blocks in a desired pattern;

graphically displaying the desired pattern as a grid of the blocks;

selecting edge rolling indicators and/or folding indicators based on stitch pattern conditions of the displayed pattern and a plurality of rules that specify edge rolling and/or folding indicators for different stitch pattern conditions, where the stitch pattern conditions include orientations of edges of segments of stitches of a given type and orientations of boundaries between segments of stitches of different types; and applying the selected edge rolling indicators and/or folding indicators to the displayed pattern, wherein the edge rolling and/or folding indicators respectively and graphically illustrate predicted edge rolling and folding behaviors of a physical textile or fabric.

18. The non-transitory computer readable medium of claim 17 wherein receiving graphical input from the user regarding the knit pattern, stitch geometry, and stitch type includes receiving input from the user regarding knit and purl stitches to be included in the textile or fabric design.

19. The non-transitory computer readable medium of claim 17 wherein applying the edge rolling and/or folding indicators includes applying the edge rolling indicators to edges of blocks of knit and purl stitches oriented at non-oblique angles with respect to a course or wale direction.

20. The non-transitory computer readable medium of claim 17 wherein applying the edge rolling and/or folding indicators comprises applying the edge rolling indicators to edges of blocks of knit and purl stitches that are oriented at oblique angles with respect to a course or wale direction, and then applying the folding indicators horizontally and vertically along longest continuous segments of knit or purl stitches.

* * * * *